US011690491B2

(12) United States Patent
Yiu et al.

(10) Patent No.: US 11,690,491 B2
(45) Date of Patent: Jul. 4, 2023

(54) SURFACE CLEANING APPARATUS

(71) Applicant: BISSELL Inc., Grand Rapids, MI (US)

(72) Inventors: Kan Yuk Yiu, Hong Kong (CN); Jian Yun Pi, Gao'an (CN)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/697,461

(22) Filed: Mar. 17, 2022

(65) Prior Publication Data

US 2022/0202265 A1 Jun. 30, 2022

Related U.S. Application Data

(63) Continuation of application No. 16/443,488, filed on Jun. 17, 2019, now Pat. No. 11,311,166, which is a continuation of application No. 15/406,100, filed on Jan. 13, 2017, now Pat. No. 10,327,615, which is a (Continued)

(51) Int. Cl.

| | |
|---|---|
| ***A47L 11/30*** | (2006.01) |
| ***A47L 11/40*** | (2006.01) |
| ***A47L 9/12*** | (2006.01) |
| ***A47L 9/16*** | (2006.01) |
| ***A47L 9/32*** | (2006.01) |
| ***B67C 11/00*** | (2006.01) |

(52) U.S. Cl.

CPC ..... *A47L 11/30* (2013.01); *A47L 9/122* (2013.01); *A47L 9/16* (2013.01); *A47L 9/1666* (2013.01); *A47L 9/325* (2013.01); *A47L 11/4027* (2013.01); *A47L 11/4044* (2013.01); *A47L 11/4083* (2013.01); *A47L 11/4086* (2013.01); *A47L 11/4088* (2013.01); *B67C 11/00* (2013.01); *B67C 2011/20* (2013.01)

(58) Field of Classification Search

CPC . A47L 11/30; A47L 9/122; A47L 9/16; A47L 9/1666; A47L 9/325; A47L 11/4027; A47L 11/4044; A47L 11/4083; A47L 11/4086; A47L 11/4088; A47L 11/40; A47L 13/22; B67C 11/00; B67C 2011/20

See application file for complete search history.

(56) References Cited

U.S. PATENT DOCUMENTS

| | | | |
|---|---|---|---|
| 3,628,577 | A | 12/1971 | Kruis |
| 3,639,939 | A | 2/1972 | Crener et al. |
| 5,896,617 | A | 4/1999 | Kasen et al. |

(Continued)

FOREIGN PATENT DOCUMENTS

| | | | |
|---|---|---|---|
| EP | 1027855 | A2 | 8/2000 |
| FR | 2759613 | A1 | 8/1998 |
| FR | 2423240 | A | 8/2006 |

*Primary Examiner* — David Redding

(74) *Attorney, Agent, or Firm* — Warner Norcross + Judd LLP

(57) ABSTRACT

A surface cleaning apparatus having a housing, a suction nozzle, a suction source, a steam port, a steam supply system, and a flexible seal. The housing having a cleaning foot and an upper housing operably coupled to the cleaning foot. The suction source being fluidly connected to the suction nozzle by a working air conduit. The steam port having an aperture provided in the cleaning foot. The steam supply system having a steam nozzle with at least a portion that projects through the steam port. The flexible seal being provided at least around the steam nozzle.

20 Claims, 17 Drawing Sheets

Related U.S. Application Data continuation of application No. 14/192,963, filed on Feb. 28, 2014, now Pat. No. 9,560,948.

(60) Provisional application No. 61/771,338, filed on Mar. 1, 2013.

(56) References Cited

U.S. PATENT DOCUMENTS

| | | | | |
|---|---|---|---|---|
| 6,167,586 | B1 | 1/2001 | Reed, Jr. et al. | |
| 6,748,622 | B2 | 6/2004 | Lee et al. | |
| 10,327,615 | B2 * | 6/2019 | Huang | A47L 11/4027 |
| 2002/0066153 | A1 | 6/2002 | Sclafani et al. | |
| 2005/0091783 | A1 | 5/2005 | Sepke et al. | |
| 2013/0111693 | A1 | 5/2013 | Krondorfer et al. | |
| 2013/0232713 | A1 | 9/2013 | Luedke et al. | |

* cited by examiner

SURFACE CLEANING APPARATUS

CROSS-REFERENCE TO RELATED APPLICATION(S)

This application is a continuation of U.S. application Ser. No. 16/443,488, filed Jun. 17, 2019, now allowed, which is a continuation of U.S. application Ser. No. 15/406,100, filed Jan. 13, 2017, now issued U.S. Pat. No. 10,327,615, which is a continuation of U.S. application Ser. No. 14/192,963, filed Feb. 28, 2014, now U.S. Pat. No. 9,560,948, which claims the benefit of U.S. Provisional Application No. 61/771,338, filed Mar. 1, 2013, all of which are incorporated herein by reference in their entirety.

BACKGROUND

Surface cleaning apparatuses, such as vacuum cleaners and steam cleaners are configured for cleaning a wide variety of common household surfaces such as bare flooring, including tile, hardwood, laminate, vinyl, and linoleum, as well as carpets, rugs, countertops, stove tops and the like. Vacuum cleaners have a suction source for generating a suction force at a nozzle in contact with the surface to be cleaned and a collection system collects debris from a working airstream for later disposal. Typically, steam cleaners have at least one liquid tank or reservoir for storing a liquid, generally water, which is fluidly connected to a steam generator via a flow control mechanism, such as a pump or valve. The steam generator includes a heater for heating the liquid to produce steam, which can be directed towards the surface to be cleaned through a steam outlet, typically located in a foot or cleaning head that engages the surface to be cleaned during use. The steam is typically applied to the backside of a cleaning pad that is attached to the cleaning head. The steam saturates the cleaning pad, and the damp cleaning pad is wiped across the surface to be cleaned to remove dirt, debris, and other soils present on the surface. Some surface cleaning apparatus combine multiple types of cleaning actions, such as vacuum cleaning with steam cleaning. In this case, both liquid and debris can be collected form a surface to be cleaned.

BRIEF DESCRIPTION

A surface cleaning apparatus, comprising a housing comprising a cleaning foot and an upper housing operably coupled to the cleaning foot, the cleaning foot having a bottom, a suction nozzle provided on the cleaning foot, a suction source fluidly connected to the suction nozzle by a working air conduit, a steam port comprising an aperture provided in the cleaning foot, a steam supply system comprising a steam nozzle having at least a portion that projects through the steam port, the steam nozzle comprising at least one steam orifice, and a flexible seal provided around the steam nozzle and located between the steam port and the steam orifice.

DETAILED DESCRIPTION

Figure 1:
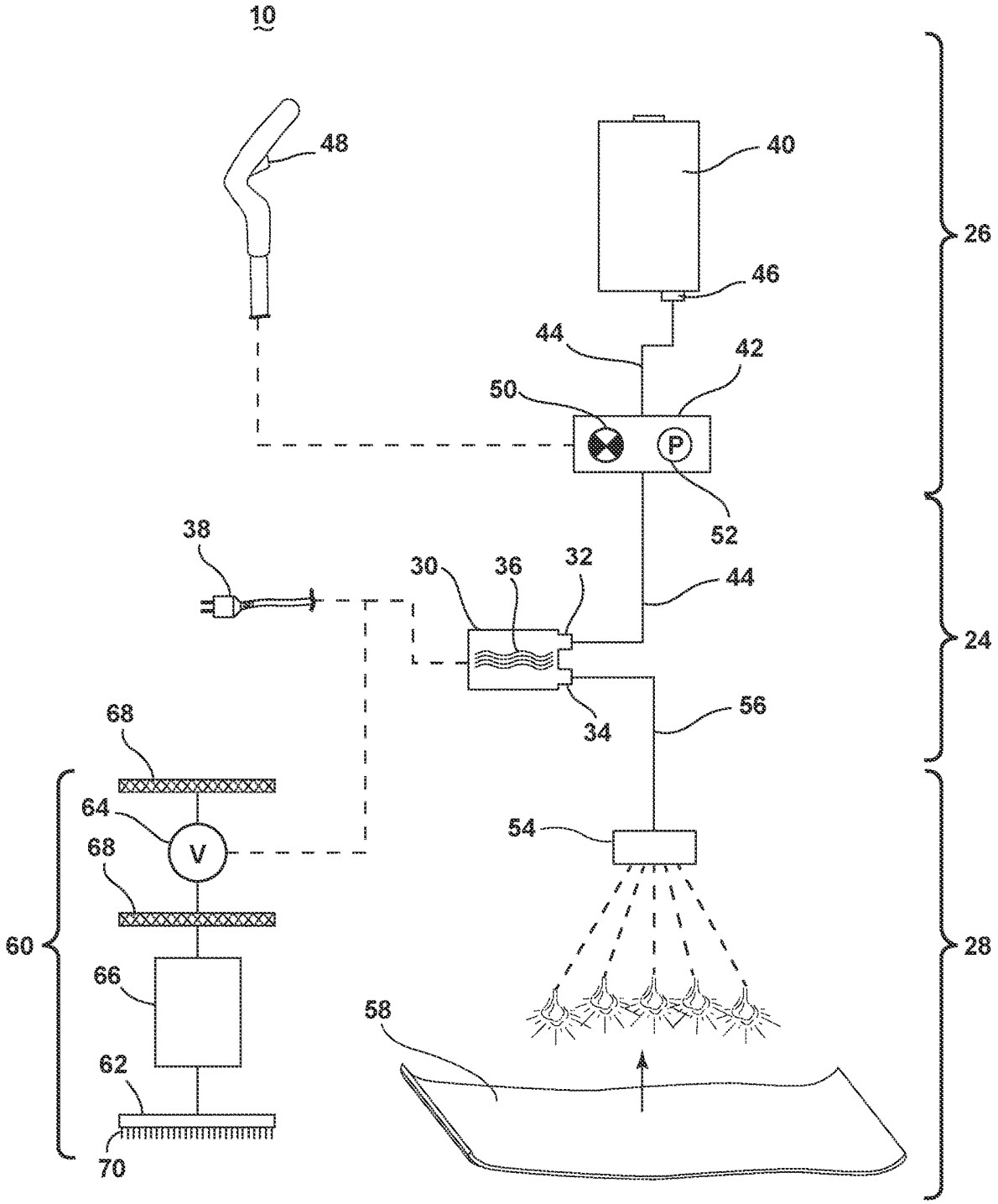
FIG. 1 is a schematic view of a surface cleaning apparatus.

FIG. 1 is a schematic view of various functional systems of a surface cleaning apparatus in the form of a steam/vacuum cleaner 10. While referred to herein as a steam/vacuum cleaner 10, some aspects of the apparatus can alternatively be configured as steam cleaner without vacuum capability, a vacuum cleaner without steam capability, a hand-held device, or as an apparatus having a hand-held accessory tool connected to a canister or other portable device by a hose. Additionally, the surface cleaning apparatus can be configured to have additional capability, including scrubbing, sweeping, and/or extraction capability.

The steam/vacuum cleaner 10 includes a steam generation system 24 for producing steam from liquid, a liquid distribution system 26 for storing liquid and delivering the liquid to the steam generation system 24, a steam delivery system 28 for delivering steam to a surface to be cleaned, and a vacuum collection system 60 for creating a partial vacuum to suck up liquid and debris from a surface to be cleaned and collecting the liquid and debris from a working airstream for later disposal.

The steam generation system 24 can include a steam generator 30 for producing steam from liquid. The steam generator 30 can include an inlet 32 and an outlet 34, and a heater 36 between the inlet 32 and outlet 34 for boiling the liquid. Some non-limiting examples of steam generators 30 include, but are not limited to, a flash heater, a boiler, an immersion heater, and a flow-through steam generator. The steam generator 30 can be electrically coupled to a power source 38, such as a battery or by a power cord plugged into a household electrical outlet.

The liquid distribution system 26 can include at least one supply tank 40 for storing a supply of liquid. The liquid can comprise one or more of any suitable cleaning liquids, including, but not limited to, water, compositions, concentrated detergent, diluted detergent, etc., and mixtures thereof. For example, the liquid can comprise a mixture of water and concentrated detergent. The liquid distribution system 26 can further include multiple supply tanks, such as one tank containing water and another tank containing a cleaning agent.

The liquid distribution system 26 can comprise a flow controller 42 for controlling the flow of liquid through a fluid conduit 44 coupled between an outlet port 46 of the supply tank 40 and the inlet 32 of the steam generator 30. An actuator 48 can be provided to actuate the flow controller 42 and dispense liquid to the steam generator 30.

In one configuration, the liquid distribution system 26 can comprise a gravity-feed system and the flow controller 42 can comprise a valve 50, whereby when valve 50 is open, liquid will flow under the force of gravity, through the fluid conduit 44, to the steam generator 30. The actuator 48 can be operably coupled to the valve 50 such that pressing the actuator 48 will open the valve 50. The valve 50 can be mechanically actuated, such as by providing a push rod with one end coupled to the actuator 48 and another end in register with the valve 50, such that pressing the actuator 48 forces the push rod to open the valve 50. Alternatively, the valve 50 can be electrically actuated, such as by providing an electrical switch between the valve 50 and the power source 38 that is selectively closed when the actuator 48 is actuated, thereby powering the valve 50 to move to an open position.

In another configuration, the flow controller 42 can comprise a pump 52 that distributes liquid from the supply tank 40 to the steam generator 30. The actuator 48 can be operably coupled to the pump 52 such that pressing the actuator 48 will activate the pump 52. The pump 52 can be electrically actuated, such as by providing electrical switch between the pump 52 and the power source 38 that is selectively closed when the actuator 48 is actuated, thereby activating the pump 52.

The steam delivery system 28 can include at least one steam outlet 54 for delivering steam to the surface to be cleaned, and a fluid conduit 56 coupled between an outlet 34 of the steam generator 30 and the at least one steam outlet 54. The at least one steam outlet 54 can comprise any structure, such as a perforated manifold or at least one nozzle; multiple steam outlets can also be provided. In use, the generated steam exits the outlet 34 of the steam generator 30 by pressure generated within the steam generator 30 and, optionally, by pressure generated by the pump 52. The steam flows through the fluid conduit 56, and out of the at least one steam outlet 54.

A cleaning pad 58 can be removably attached over the steam outlet 54 to the steam/vacuum cleaner 10. In use, the cleaning pad 58 is saturated by the steam from the steam outlet 54, and the damp cleaning pad 58 is wiped across the surface to be cleaned to remove dirt present on the surface. The cleaning pad 58 can be provided with features that enhance the scrubbing action on the surface to be cleaned to help loosen dirt on the surface. The cleaning pad 58 can be disposable or reusable, and can further be provided with a cleaning agent or composition that is delivered to the surface to be cleaned along with the steam. For example, the cleaning pad 58 can comprise disposable sheets that are pre-moistened with a cleaning agent. The cleaning agent can be configured to interact with the steam, such as having at least one component that is activated or deactivated by the temperature and/or moisture of the steam. In one example, the temperature and/or moisture of the steam can act to release the cleaning agent from the cleaning pad 58.

The vacuum collection system 60 can include a suction nozzle 62, a suction source 64 in fluid communication with the suction nozzle 62 for generating a working air stream, and a separating and collection assembly 66 for separating and collecting liquid and debris from the working airstream for later disposal. Some examples of separating and collection assemblies 66 include, but are not limited to, a cyclone separator, a centrifugal separator, a bulk separator, a filter bag, or a water-bath separator. The suction source 64, such as a motor/fan assembly, is provided in fluid communication with the separating and collection assembly 66, and can be positioned downstream or upstream of the separating and collection assembly. The suction source 64 can be electrically coupled to the power source 38. An electrical switch between the suction source 64 and the power source 38 can be selectively closed by the user upon pressing a power button (not shown), thereby activating the suction source 64.

The vacuum collection system 60 can also be provided with one or more additional filters 68 upstream or downstream of the separating and collection assembly 66 or the suction source 64. Optionally, an agitator 70 can be provided adjacent to the suction nozzle 62 for agitating debris on the surface to be cleaned so that the debris is more easily ingested into the suction nozzle 62. Some examples of agitators 70 include, but are not limited to, a rotatable brushroll, dual rotating brushrolls, or a stationary brush.

The steam/vacuum cleaner 10 shown in FIG. 1 can be used to effectively remove debris (which may include dirt, dust, stains, and other debris) from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps.

To perform steam cleaning, the cleaning pad 58 is attached to the steam/vacuum cleaner 10, over the steam outlet 54, the supply tank 40 is filled with liquid, and the steam generator 30 is coupled to the power source 38. Upon actuation of the actuator 48, liquid flows to the steam generator 30 and is heated to its boiling point to produce steam. The steam exits the steam outlet 54 and passes through the cleaning pad 58. As steam passes through the cleaning pad 58, a portion of the steam may return to liquid form before reaching the floor surface. The steam delivered to the floor surface can sanitize the surface when exposed for a predetermined amount of time before returning to liquid form. As the damp cleaning pad 58 is wiped over the surface to be cleaned, debris is loosened or solubilized, and excess liquid, dirt and debris on the surface are absorbed by the cleaning pad 58.

To perform vacuum cleaning, the suction source 64 is coupled to the power source 38. The suction source 64 draws in dirt-laden air and/or liquid through the suction nozzle 62 and into the separating and collection assembly 66 where the debris and/or liquid is substantially separated from the working air. The air flow then passes past the suction source 64, and through any optional filters 68, prior to being exhausted from the vacuum cleaner 10. The separating and collection assembly 66 can be periodically emptied of debris and liquid. Likewise, the optional filters 68 can periodically be cleaned or replaced.

Figure 2:
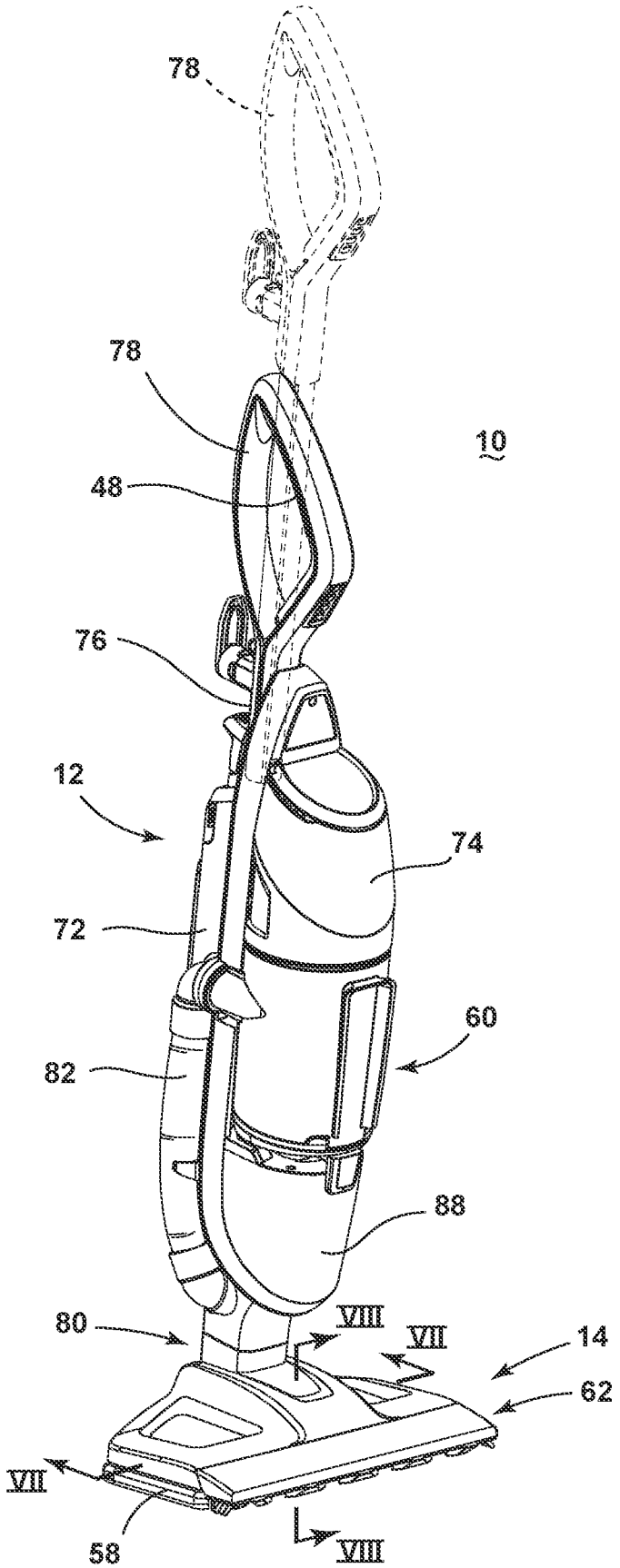
FIG. 2 is a front perspective view of a surface cleaning apparatus in the form of a steam/vacuum cleaner.

FIG. 2 is a front perspective view of a steam cleaning apparatus in the form of a steam/vacuum cleaner 10 according to a first example. For purposes of description related to the figures, the terms "upper," "lower," "right," "left," "rear," "front," "vertical," "horizontal," "inner," "outer," and derivatives thereof shall relate to the orientation in FIG. 1 from the perspective of a user behind the steam/vacuum cleaner 10, which defines the rear of the steam/vacuum cleaner 10. However, it is to be understood that various alternative orientations may be utilized, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The steam/vacuum cleaner 10 comprises an upper housing 12 mounted to a lower cleaning foot 14 which is adapted to be moved across a surface to be cleaned. The housing 12 and the foot 14 may each support one or more components of the various functional systems discussed with respect to FIG. 1. The upper housing 12 generally comprises a main support section 72 with a separating and collection assembly 66 on a front portion thereof for separating and collecting debris and liquid from a working airstream for later disposal. A motor cavity 74 is formed at an upper end of the support section 72, above the collection assembly 66, and contains a conventional suction source such as a motor/fan assembly 64 (FIGS. 1 and 9) positioned therein in fluid communication with the collection assembly 66. The foot 14 includes a suction nozzle 62 that is in fluid communication with the suction source in the motor cavity 74, through the collection assembly 66.

An elongated handle 76 can project from the main support section 72, with a handle grip 78 provided on the end of the handle 76 to facilitate movement of the steam/vacuum cleaner 10 by a user. The actuator 48 can be provided on the handle grip 78. A coupling joint 80 is formed at an opposite end of the housing 12 and moveably mounts the foot 14 to the housing 12. In the example shown herein, the foot 14 can pivot up and down about one axis relative to the housing 12. The coupling joint 80 can alternatively comprise a universal joint, such that the foot 14 can pivot about at least two axes relative to the housing 12. The working air conduit between the suction nozzle 62 and the collection assembly 66 can extend though the coupling joint 80 and an external conduit 82 connected between the coupling joint 80 and the collection assembly 66. The external conduit 82 can be a flexible hose or a rigid conduit.

Figure 3:
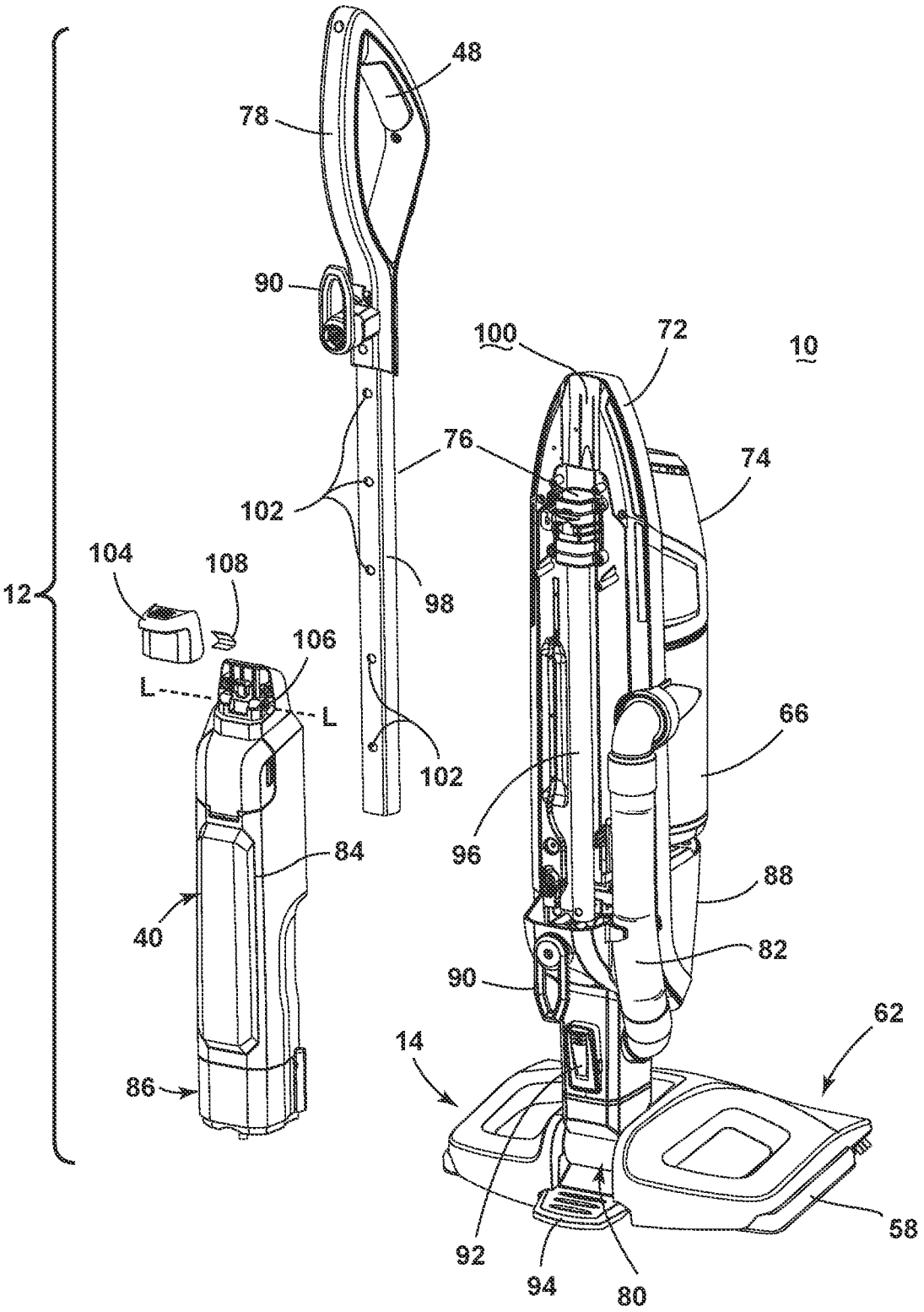
FIG. 3 is a partially exploded rear perspective view of the steam/vacuum cleaner from FIG. 2.

FIG. 3 is a rear perspective, partially exploded view of the steam/vacuum cleaner 10. The upper housing 12 further comprises a supply tank 40 supported on a rear portion of the main support section 72 for storing a supply of liquid. The housing 12 has a window 84 which allows the user to view the supply tank 40 and ascertain the level of liquid within the supply tank 40. A filter assembly 86 is supported on a rear portion of the main support section 72, below the supply tank 40, for filtering the liquid passing out of the supply tank 40. A heater cavity 88 is formed at a front, lower end of the support section, below the collection system, and contains a steam generator 30 (FIGS. 1 and 9) positioned therein in fluid communication with the supply tank 40, through the filter assembly 86. Cord wraps 90 are provided on the rear portion of the upper housing 12, below and above the supply tank 40, and store a power cord (such as power cord 38 shown in FIG. 1) which can plugged into a household electrical outlet to provide power to various components of the steam/vacuum cleaner, such as but not limited to the steam generator 30 and the suction source 64.

The foot 14 is detachably mounted to the upright housing 12 by a latch 92 provided on the rear of the coupling joint 80. The foot 14 includes a cleaning pad 58 mounted to a bottom surface of the foot 14 to contact the surface to be cleaned and a removable pad mounting plate 94 provided on the bottom of the foot 14 for mounting the cleaning pad 58 to the foot 14.

The handle 76 of the steam/vacuum cleaner 10 is height-adjustable, and can telescope between a fully retracted position shown in solid line in FIG. 1, which corresponds to the shortest length of the handle 76, and a fully extended position shown in phantom line in FIG. 1, which corresponds to the longest length of the handle 76. The telescoping handle 76 comprises an inner handle tube 96 and an outer handle tube 98 sliding received over the inner handle tube 96. The main support section 72 and the supply tank 40 together define a cavity 100 that is configured to slidably receive the telescoping handle 76 therein, with the inner handle tube 96 fixed in place and the upper handle tube 98 configured to slide upwardly and downwardly relative the stationary inner handle tube 96. The outer handle tube 98 comprises a plurality of detents 102, illustrated as recessed depressions, for adjusting the handle 76 between the fully extended and retracted positions shown in FIG. 1, or various intermediate positions therebetween (not shown). The hand grip 78 is provided on the top of the outer handle tube 98. The upper cord wrap 90 can also be carried by the outer handle tube 98.

A handle locking mechanism is provided on the rear side of the main support section 72 and comprises a spring-loaded button 104 pivotally mounted on the main support section 72 about an axis L that is defined by a button bearing 106 on the main support section 72, above the supply tank 40. A spring 108 biases the button 104 toward the outer handle tube 98.

Figure 5:
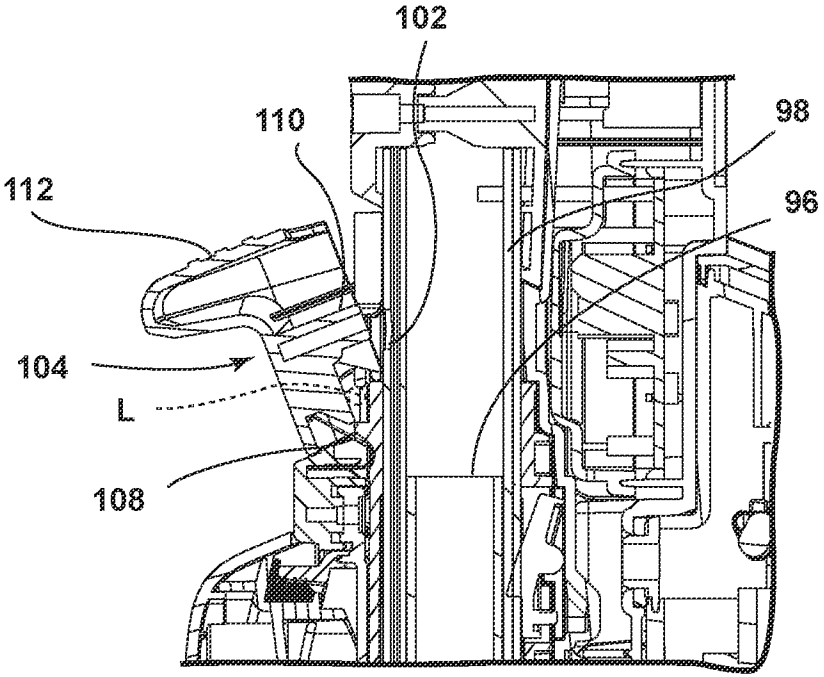
FIG. 4-5 are sectional views through a handle locking mechanism of the steam/vacuum cleaner from FIG. 2.
Figure 4:
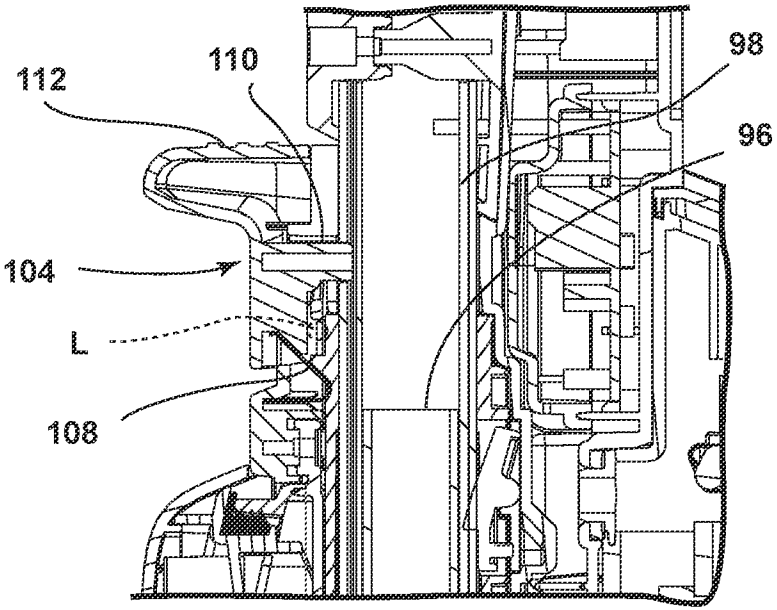

FIGS. 4-5 are sectional views through the assembled handle locking mechanism. The button 104 is coupled with a latch 110 configured to engage one of the detents 102 in the outer handle tube 98, as shown in FIG. 4. The spring 108 biases the latch 110 toward the detent 102. To adjust the height or length of the handle 76, a user can depress an upper portion 112 of the button 104, causing the button 104 to pivot about the axis L and move the latch 110 out of engagement with the detent 102, as shown in FIG. 5. The user then slides the outer handle tube 98 over the inner handle tube 96 to a desired length, and releases the button 104 to allow the latch 110 to engage the detent 102 associated with the desired length.

Figure 6:
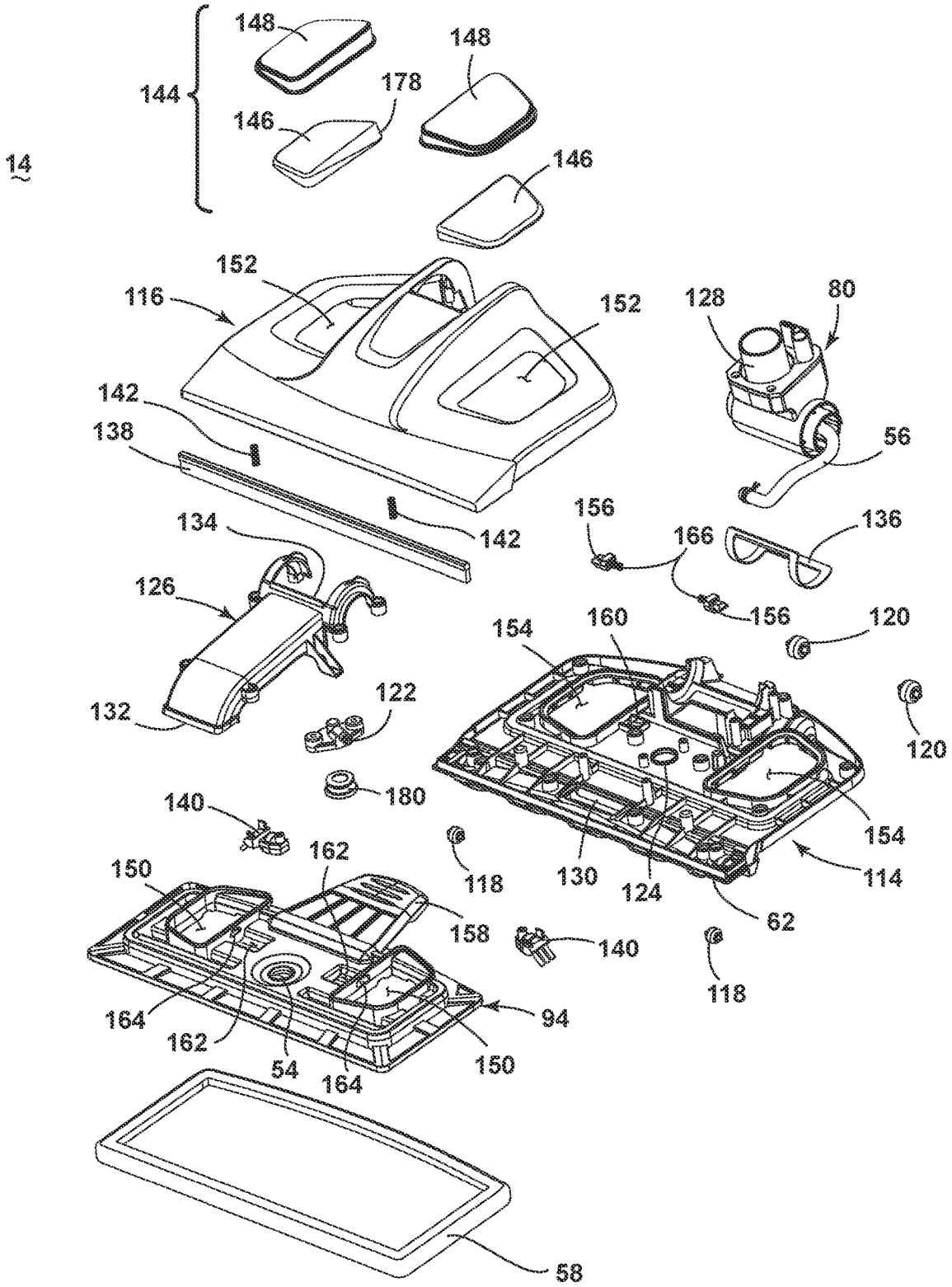
FIG. 6 is an exploded view of a foot of the steam/vacuum cleaner from FIG. 2.

FIG. 6 is an exploded view of the foot 14 of the steam/vacuum cleaner 10 shown in FIG. 2. The foot 14 can comprise a housing adapted to be moved over the surface to be cleaned and which can mount the cleaning pad 58, generally described with respect to FIG. 1. The housing includes a base frame 114 and an upper cover 116 mounted to the top of the base frame 114. The removable pad mounting plate 94 is provided on the bottom of the base frame 114 for mounting the cleaning pad 58 in register with the foot 14. A set of front wheels 118 and a set of rear wheels 120 are provided on the base frame 114 for maneuvering the foot 14 over a surface to be cleaned.

The foot 14 includes a steam nozzle 122 and at least one steam outlet 54 in fluid communication with the steam nozzle 122. In the illustrated example, the at least one steam outlet includes a steam orifice 54 formed in the pad mounting plate 94. A steam port 124 is formed in the base frame 114 and aligned with the steam orifice 54 to provide a passage for steam from the steam nozzle 122 through the base frame 114. A fluid conduit 56 is coupled between the steam generator 30 (FIGS. 1 and 9) and the steam nozzle 122, and can extend at least partially through the coupling joint 80. At least a portion of the conduit 56 can be flexible to accommodate for the movement of the coupling joint 80.

The foot 14 further includes a flue 126 extending from the suction nozzle 62 to a fluid conduit 128 in fluid communication with the collector assembly 66 (FIG. 2). The fluid conduit 128 can pass through the coupling joint 80 and couple with the conduit 82. The suction nozzle 62 is formed with the base frame 114 and comprises a nozzle inlet 130 which mates with an inlet end 132 of the flue 126. An outlet end 134 of the flue 126 mates with the coupling joint 80, which can rotate relative to the outlet end 134. A seal 136 can be positioned between the flue 126 and the coupling joint 80 to maintain a fluid-tight connection throughout the range of movement of the coupling joint 80.

In addition to the cleaning pad 58, the foot 14 can be provided with one or more additional agitators. In the illustrated example, the foot 14 is provided with an elongated, brush 138 positioned behind the suction nozzle 62 and a pair of edge brushes 140 positioned at the ends of the suction nozzle 62 and which protrude outwardly from the base frame 114. The brush 138 can be slidably mounted to the base frame 114 to float over the surface to be cleaned, such that the brush 138 automatically adjusts to different floor surface features, carpet pile heights, bare floor, etc. A spring 142 is positioned between the bottom of the base frame 114 and the top of the brush 138 for biasing the brush downwardly toward the surface to be cleaned, while still permitting the brush 138 to move freely up and down, or float, along the surface to be cleaned during operation, thereby permitting the brush 138 to automatically adjust to the type of surface below the foot 14. Optionally, a squeegee can replace, or be used in conjunction with, the brush 138.

The foot 14 is provided with one more viewing window(s) 144 to allow the user to view the cleaning pad 58 mounted to the foot 14. The viewing windows 144 also allow for the user to see the condensation of steam on the windows 144, which acts as a visual confirmation that steam is being produced and delivered to the foot 14. In the illustrated example, a viewing window 144 is provided on each side of the coupling joint 80. Each window 144 comprises an inner pane 146 mounted to the pad mounting plate 94 and an outer pane 148 mounted to the base cover 116. The inner panes 146 can seat within the outer panes 148 when the pad mounting plate 94 is coupled with the foot 14. Both panes 146, 148 can be made of a light transmissive material. In other examples, only a single pane of light transmissive material may be required.

The pad mounting plate 94 and the base cover 116 can be provided with aligned window cutouts 150, 152, respectively, and the panes 146, 148 are mounted at the cutouts 150, 152. Likewise, the base frame 114 is provided with window cutouts 154 aligned with the other cutouts 150, 152. The outer pane 148 can be sized to receive the inner pane 146, which extends through the window cutouts 154 in the base frame 114 when the pad mounting plate 94 is coupled with the foot 14. Alternatively, the panes 146, 148 can be integrally formed with the pad mounting plate 94, base cover 116, or base frame 114.

The foot 14 has a lock mechanism for selectively locking the pad mounting plate 94 to the base frame 114. In the illustrated example, the locking mechanism comprising two opposing spring-biased latches 156 moveably mounted to the base frame 114 and a user engageable latch actuator, illustrated and described as a foot pedal 158, coupled with the pad mounting plate 94. The latches 156 can be slidably mounted in pockets 160 provided on the base frame 114. The pad mounting plate 94 is provided with pocket receivers 162 which accommodate the pockets 160 when the pad mounting plate 94 is coupled with the foot 14. Detents 164 corresponding to the latches 156 are formed in the pocket receivers 162. Biasing elements 166 can be provided within the pockets 160 to bias the latches 156 outwardly toward the corresponding detents 164 formed in the pad mounting plate 94. The biasing elements 166 can comprise springs in the form of coil springs.

Figure 7:
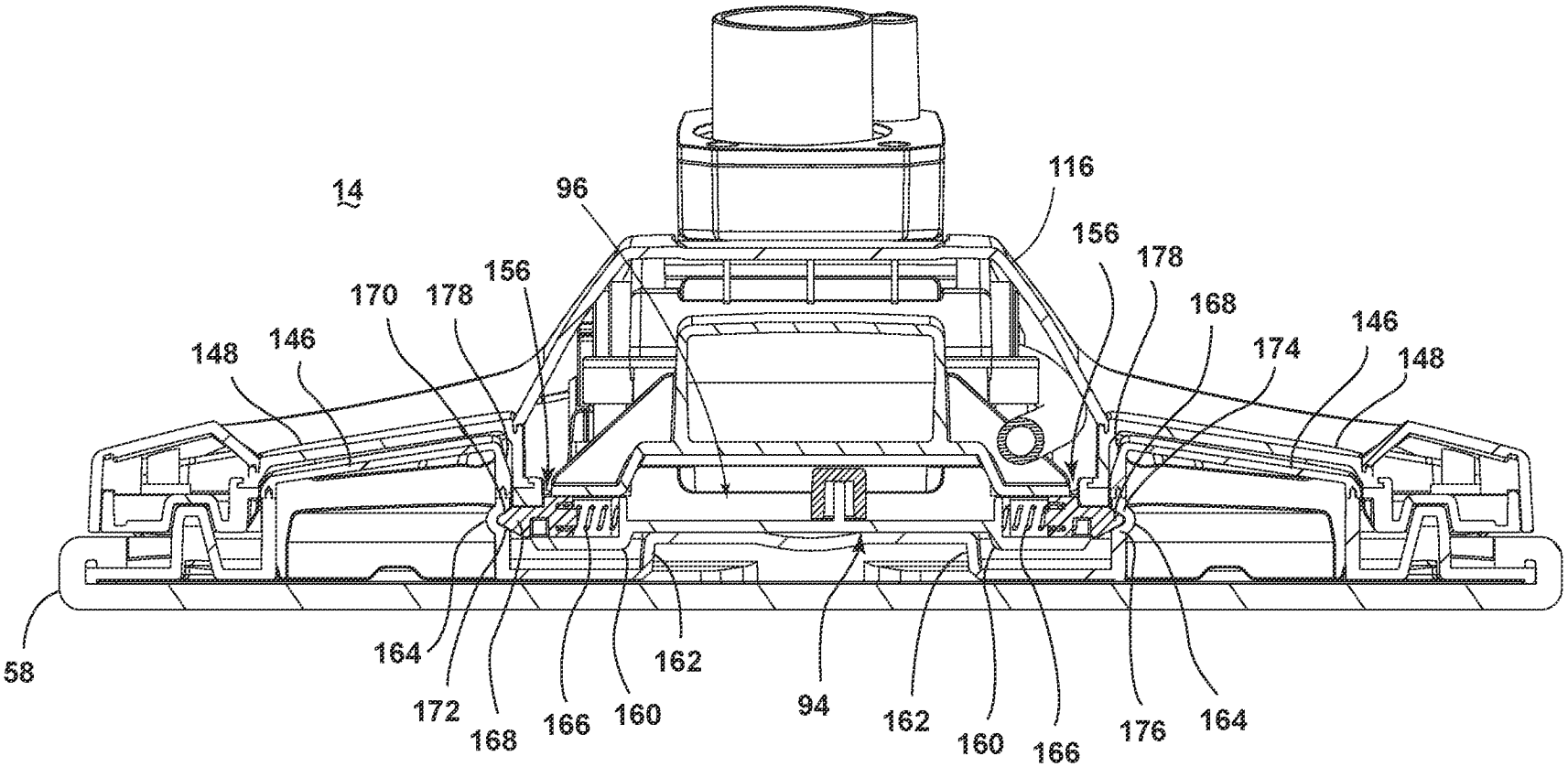
FIG. 7 is a cross-sectional view through a foot of the steam/vacuum cleaner from FIG. 2, taken through line VII-VII of FIG. 2.

FIG. 7 is a cross-sectional view through the lock mechanism for the pad mounting plate 94, taken through line VII-VII of FIG. 2. Each latch 156 has an arrow-shaped catch 168 which move into and out of the pockets 160 to engage or disengage the detents 164. The arrow-shaped catch 168 has upper and lower angled surfaces 170, 172. The detent 164 has a corresponding arrow-shape with upper and lower angled surfaces 174, 176. A guide surface 178 can be provided on the pad mounting plate 94 for guiding the catches 168 toward the detents 164. As shown herein, the guide surfaces 178 can be angled edges of the inner window panes 146.

With reference to FIGS. 6-7, to attach the pad mounting plate 94 to the foot 14, a user can locate the front edge of the pad mounting plate 94 behind the suction nozzle 62 and press the foot 14 toward the pad mounting plate 94. The lower angled surface 172 of the catch 168 contacts the guide surface 178 on the pad mounting plate 94, which forces the latch 156 inwardly and compresses the biasing element 166 within the pocket 160. When the pad mounting plate 94 is fully seated, the biasing element 166 pushes the latch 156 outwardly so that the catch 168 extends into the detent 164 to retain the pad mounting plate 94 to the base frame 114 of the foot 14. To remove the pad mounting plate 94, the user simply steps or pushes down on the foot pedal 158 of the pad mounting plate 94 while lifting upwardly on the foot 14, such as by lifting the steam/vacuum cleaner 10 by the upright housing 12 (FIG. 2). This forces the upper angled surface 172 of the catch 168 against the upper angled surface 174 of the detent 164 and urges the latch 156 inwardly until the catch 168 clears the detent 164 and the steam/vacuum cleaner 10 can be lifted away from the pad mounting plate 94.

The lock mechanism for the pad mounting plate 94 can make it especially convenient for the user to assemble or remove the cleaning pad 58 since a user can pick up the removed pad mounting plate 94 and attach the cleaning pad 58 at their convenience, rather than having to bend over or flip the entire steam/vacuum cleaner 10 over. For example, a user could remove the pad mounting plate 94, pick up the pad mounting plate 94, and place the pad mounting plate 94 on a countertop to remove or mount the cleaning pad 58. To re-install the pad mounting plate 94, the user can set the pad mounting plate 94 on the floor, and press the steam/vacuum cleaner 10 onto the steam/vacuum cleaner 10.

Figure 8:
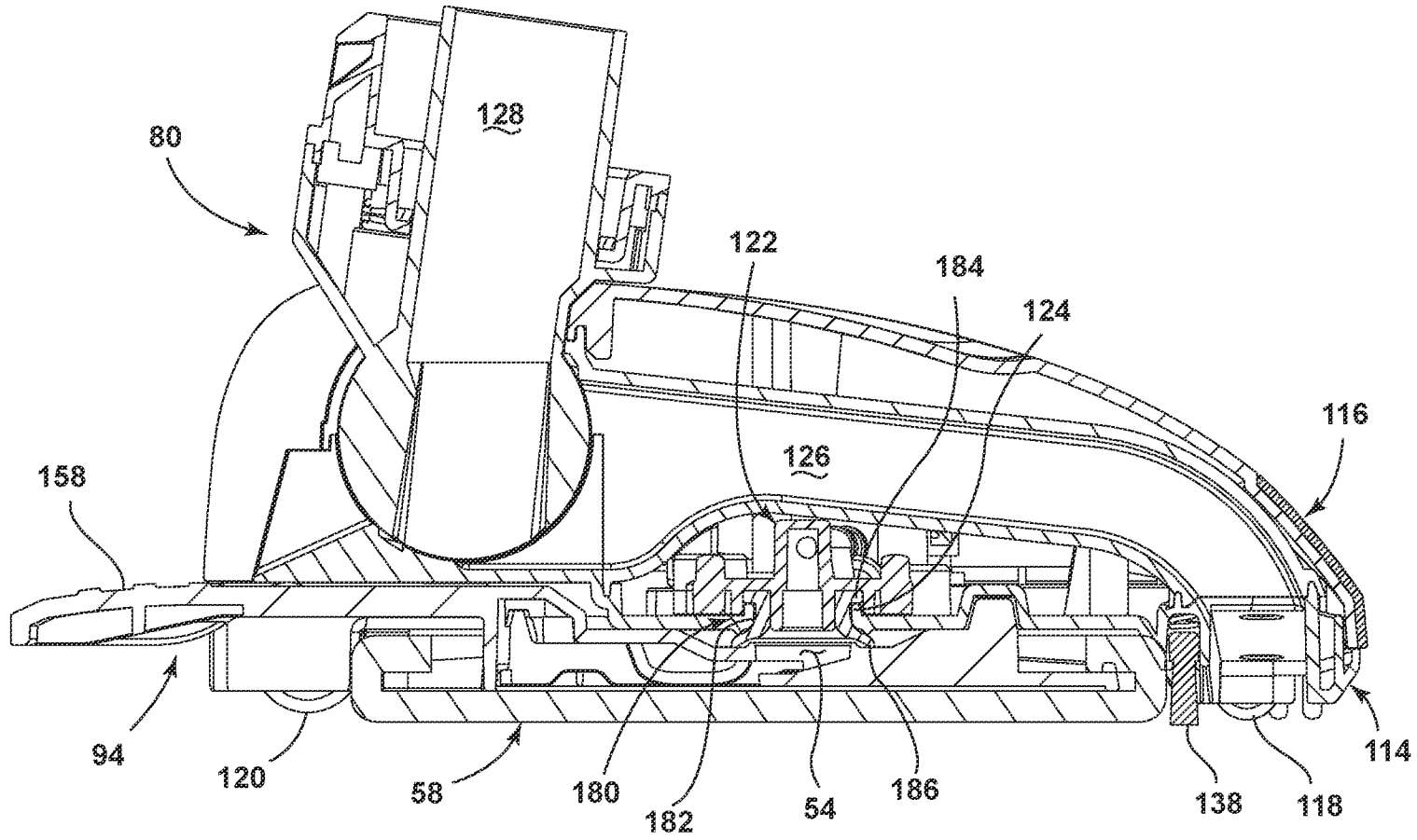
FIG. 8 is a cross-sectional view through a foot of the steam/vacuum cleaner from FIG. 2, taken through line VIII-VIII of FIG. 2.

FIG. 8 is a cross-sectional view of the foot 14 taken through line VIII-VIII of FIG. 2. The outlet portion of the steam nozzle 122 projects through the steam port 124 in the base frame 114 toward the steam orifice 54 in the pad mounting plate 94. A flexible seal 180 is provided around the steam nozzle 122 and positioned between the steam port 124 and the steam orifice 54 for preventing steam leakage into the foot 14. The seal 180 is generally spool-shaped, with a barrel 182 having an upper flange 184 and a lower flange 186. The barrel 182 extends through the steam port 124, with the upper flange 184 holding the seal 180 on the base frame 114. The lower flange 186 contacts the upper surface of the pad mounting plate 94 and surrounds the steam orifice 54.

As disclosed above, the foot 14 is supported by wheels 118, 120 that are mounted on the base frame 114. The pad mounting plate 94 can float relative to the base frame 114 to some extent, such that there is some vertical play between the pad mounting plate 94 and the rest of the foot 14 when the pad mounting plate 94 is coupled to the foot 14. The seal 180 compensates for the vertical float of the pad mounting plate 94 by flexing or compressing as needed to maintain contact between the lower flange 186 and the pad mounting plate 94, and prevents steam leaks from the steam nozzle 122 between the base frame 114 and the top side of the pad mounting plate 94 so that all steam flows through the steam orifice 54 to the cleaning pad 58.

Figure 9:
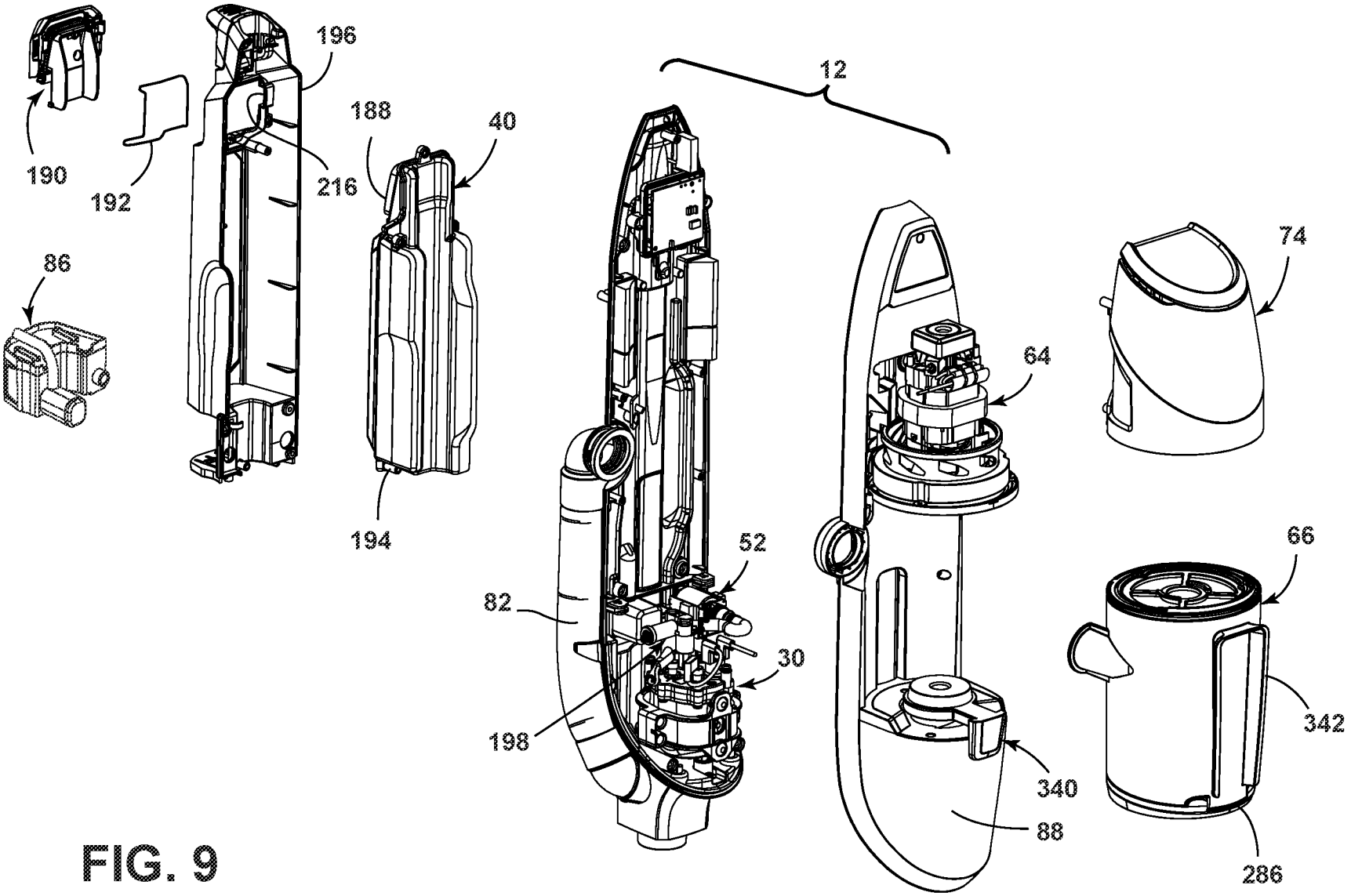
FIG. 9 is a partially exploded view of an upper housing of the steam/vacuum cleaner from FIG. 2.

FIG. 9 is a partially exploded view of the upper housing 12. The supply tank 40 defines a chamber for receiving a supply of liquid and has a fill opening 188 that is selectively closed by a fill cap 190. A seal 192 is provided between the supply tank 40 and the fill cap 190 for sealing the interface between the fill cap 190 and the supply tank 40 when the fill cap 190 is closed, and can be carried by the supply tank 40. An outlet port 194 is provided at a lower end of the supply tank 40 and fluidly connects the chamber with the filter assembly 86. In the illustrated example, the supply tank 40 is provided on the upper housing 12, and is not removable therefrom by the user for refilling. A rear cover 196 mounts the supply tank 40 to the upper housing 12, and is not intended for removal by the user of the steam/vacuum mop 10.

In this example, the pump 52 is provided in the upper housing 12, in the heater cavity 88, to control the flow of liquid to the steam generator 30, also positioned in the heater cavity 88. The filter assembly 86 is in fluid communication with the pump 52. When the pump 52 is activated by squeezing the trigger 48, liquid flows through the pump 52 into the steam generator 30. A safety valve 198 can be positioned between the pump 52 and the steam generator 30 for relieving pressure exceeding a predetermined value within the fluid flow path. For example, the safety valve 198 can be configured to automatically open to release excess fluid pressure into the atmosphere in potential situations where the flow path becomes clogged or obstructed and the steam generator 30 or pump 52 continues to generate pressure within the system.

Figure 10:
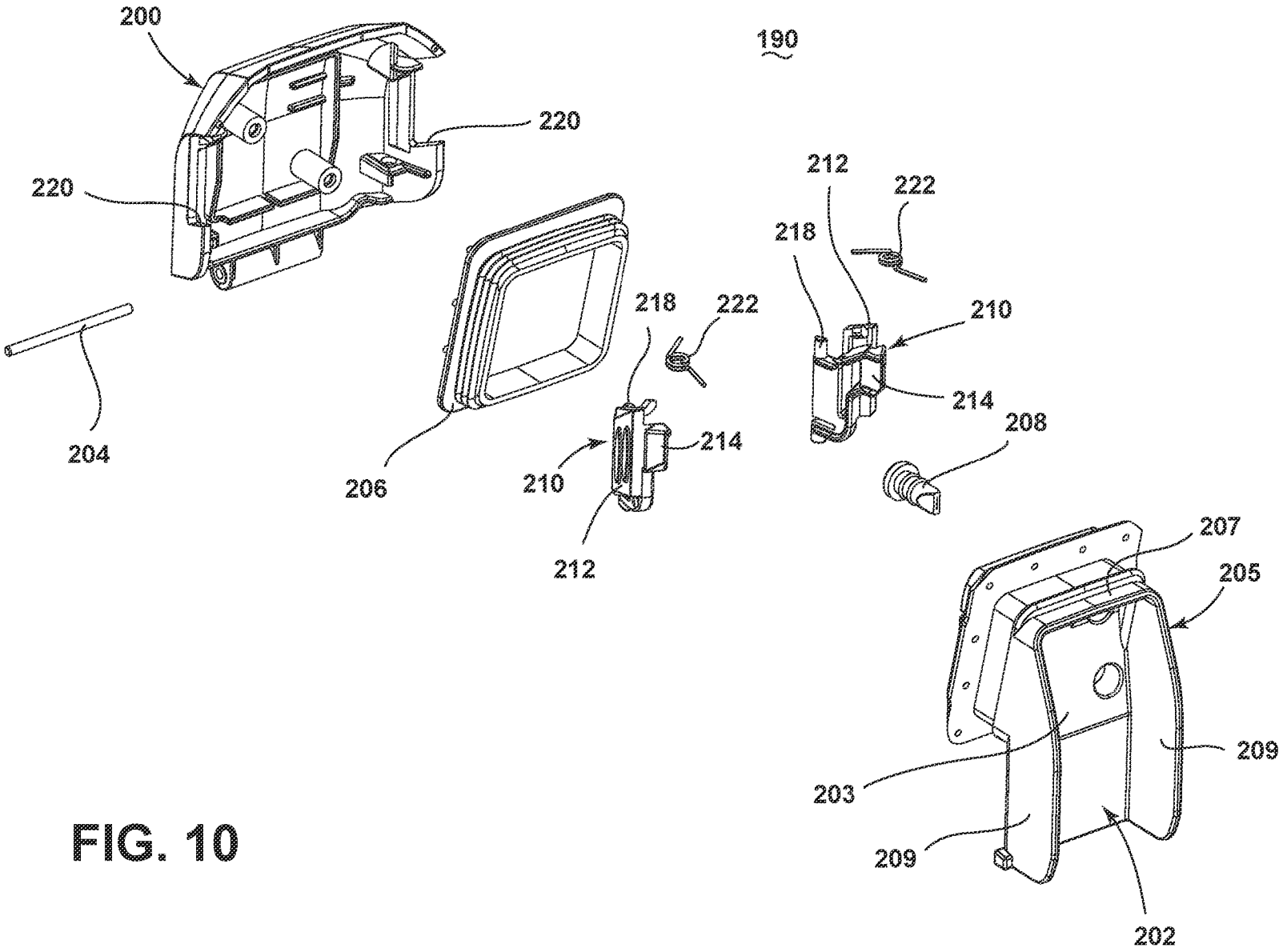
FIG. 10 is an exploded view of a fill cap for a supply tank of the steam/vacuum cleaner from FIG. 2.

FIG. 10 is an exploded view of the fill cap 190 from FIG. 9. The fill cap 190 comprises a cap body 200 and a funnel 202 provided on an inner surface of the cap body 200 for filling the supply tank 40. While illustrated herein as being formed in two pieces, the funnel 202 can alternatively be integrally formed with the cap body 200. The cap body 200 is pivotally mounted to the rear cover 196 (FIG. 9) by a pivot shaft 204. A bellows-type seal 206 is provided between the supply tank 40 and the fill opening 188 for sealing around the funnel 202 when the fill cap 190 is closed, and can be carried by the fill cap 190. A bleeder valve 208 is provided on the fill cap 190 and is configured to vent ambient atmospheric air into the supply tank 40 (FIG. 9) as liquid inside the supply tank 40 is dispensed during use.

The funnel 202 includes a base wall 203 and a partial peripheral side wall 205 extending from the base wall 203, which together guides liquid into the fill opening 188. The peripheral side wall 205 includes a medial side wall 207 and two lateral side walls 209 which may be taller than the medial side wall 207 to prevent liquid from spilling or overflowing during filling. As shown, the funnel 202 can be open at the top side, with the base wall 203 and the side wall 205 forming a chute or trough that guides liquid into the fill opening 188 as liquid is poured onto the funnel 202. When the fill cap 190 is open, the base wall 203 defines a bottom sloped surface of the funnel 202 that is angled in the direction of the supply tank 40, and the peripheral side wall 205 prevents water from spilling out of the sides of the funnel 202 as a user pours liquid into the supply tank 40.

The fill cap 190 has a latch mechanism for selectively latching the fill cap 190 in a closed position on the supply tank 40 (visible in FIG. 3). The latch mechanism comprises a pair of juxtaposed latches 210 having user-engageable outer buttons 212 and inner hooks 214 coupled with the buttons 212. The hooks 214 are configured to be retained by corresponding latch receivers 216 formed on the upright housing 12, shown on the rear cover 196 in FIG. 9.

The latches 210 have vertical pivot shafts 218 for pivotally mounting the latches 210 to pivot bearings 220 formed on an inner surface to the cap body 200. Biasing elements 222 can be provided to bias the latches 210 toward the latched position, which corresponds to the closed position shown in FIG. 3. The biasing elements 222 can comprise springs in the form of torsion springs wrapped around the pivot shafts 218 and bearing against the cap body 200.

Figure 11:
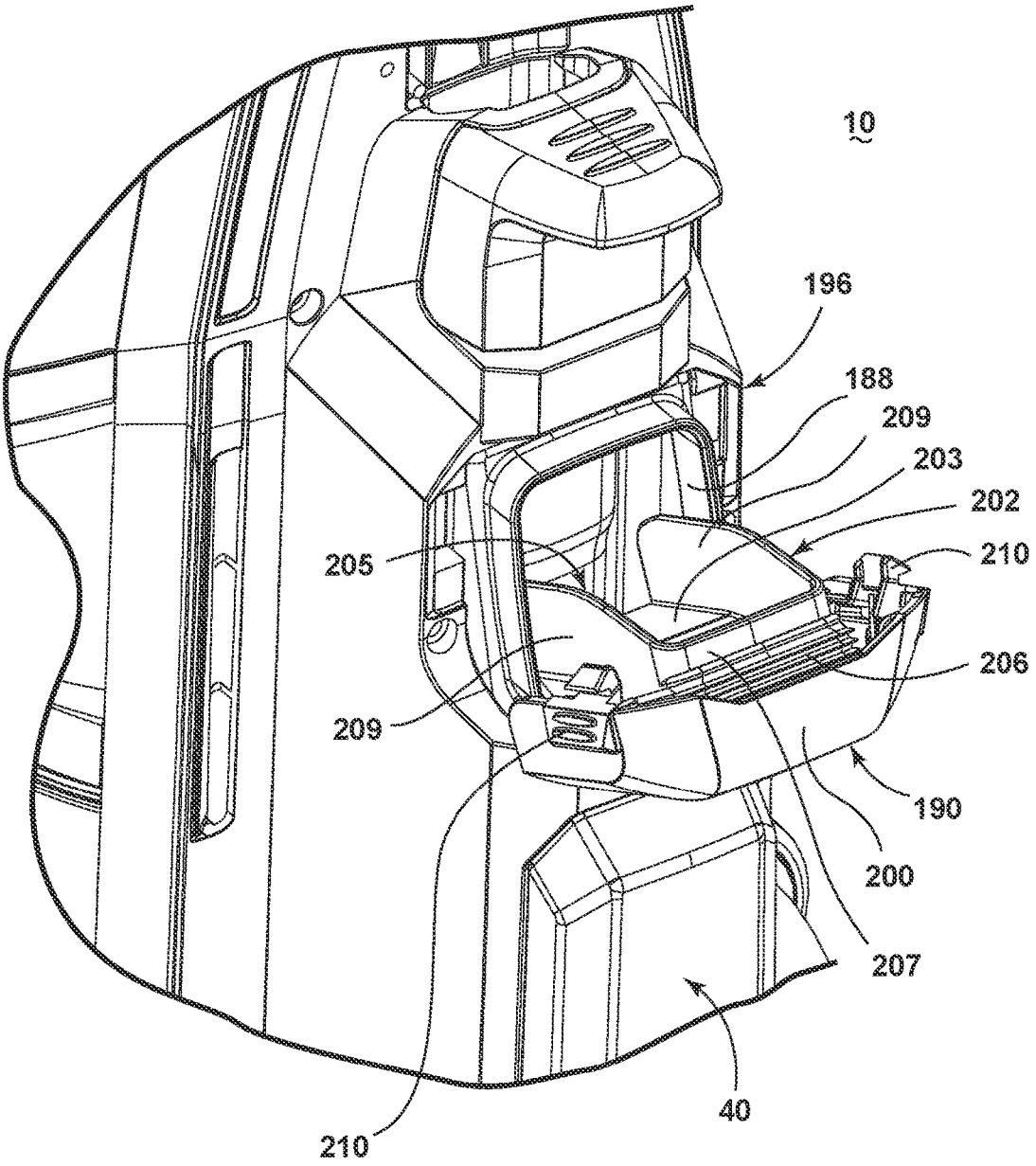
FIG. 11 is a close-up rear perspective view of the steam/vacuum cleaner from FIG. 2, showing a fill cap for the supply tank in an open or filling position.

FIG. 11 is a close-up rear perspective view of the steam/vacuum cleaner 10 from FIG. 2, showing the fill cap 190 for the supply tank 40 in an open or filling position. The fill cap 190 can be opened by squeezing the latches 210 and pivoting the cap body 200 backward about the pivot shaft 204 (FIG. 10). When the fill cap 190 is open, the funnel 202 can convey liquid from a liquid source, such as a faucet, hose, or a separate user liquid supply vessel, into the fill opening 188 of the supply tank 40. Because the supply tank 40 is not removed from the steam/vacuum cleaner 10 for filling, the extended funnel 202 makes it easier to fill the supply tank 40. Furthermore, because the fill cap 190 is hinged to the supply tank 40, the fill cap 190 will not completely separate from the supply tank 40 during filling and, therefore, will not be dropped or lost.

Figure 12:
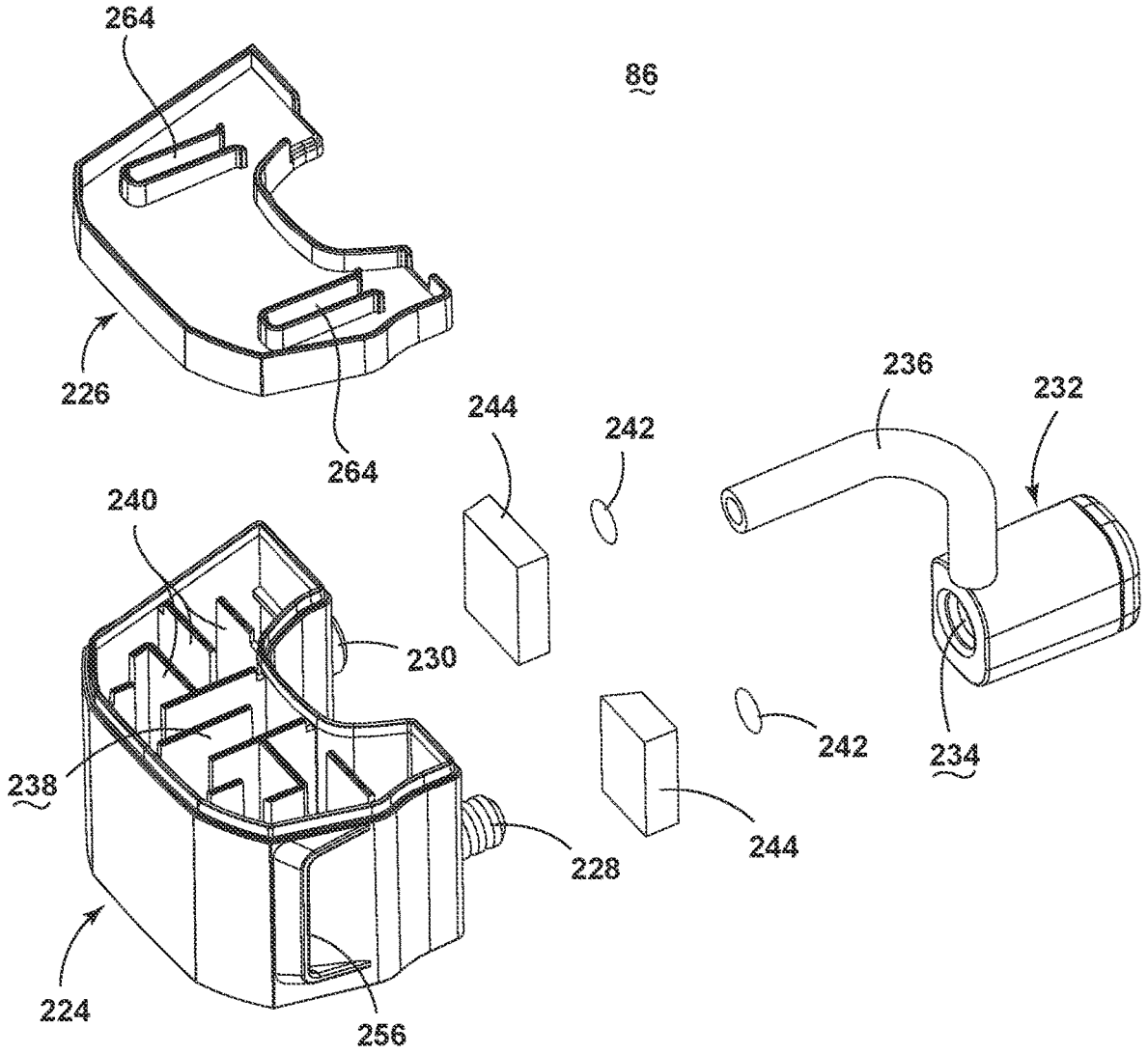
FIG. 12 is an exploded view of a filter assembly of the steam/vacuum cleaner from FIG. 2.

FIG. 12 is an exploded view of the filter assembly 86. The filter assembly 86 is configured to prevent foreign particulates and debris from entering the steam generator 30 and comprises a filter housing 224 and a filter cover 226 removably mounted to the filter housing 224. The filter housing 224 can further include an inlet neck 228 defining an inlet port in fluid communication with the outlet port 194 of the supply tank 40 and outlet neck 230 defining an outlet port which is in fluid communication with the pump 52 (FIG. 9).

A valve assembly 232 can be positioned between the outlet port 194 of the supply tank 40 and the inlet neck 228 of the filter housing 224, and includes a valve outlet seat 234 for receiving the inlet neck 228. A fluid conduit 236 can couple the valve assembly 232 to the outlet port 194 of the supply tank 40. The valve assembly 232 is adapted to move to a closed position to seal the fluid conduit 236 when the filter assembly 86 is removed from the steam/vacuum cleaner 10. When the filter assembly 86 is seated on the steam/vacuum cleaner 10, the inlet neck 228 is at least partially received within the valve outlet seat 234 to automatically move the valve assembly 232 to an open position to allow fluid flow through the fluid conduit 236.

A filtration medium 238 is provided in the filter housing 224, and can comprise a granular substance such as mixed bed ion exchange resin or polymer, which can further comprise crosslinked polystyrene beads, for example, that are configured to purify and decontaminate liquid from the supply tank 40. Accordingly, the filter housing 224 may be provided with a plurality of internal walls 240 that form a frame work for holding the filtration medium 238 and which can provide a labyrinthine structure for liquid to pass through. Additional filtration mediums can be provided in the filter assembly 86, such as mesh screens 242 and sponge filters 244 positioned at the inlet and outlet necks 228, 230.

Figure 13:
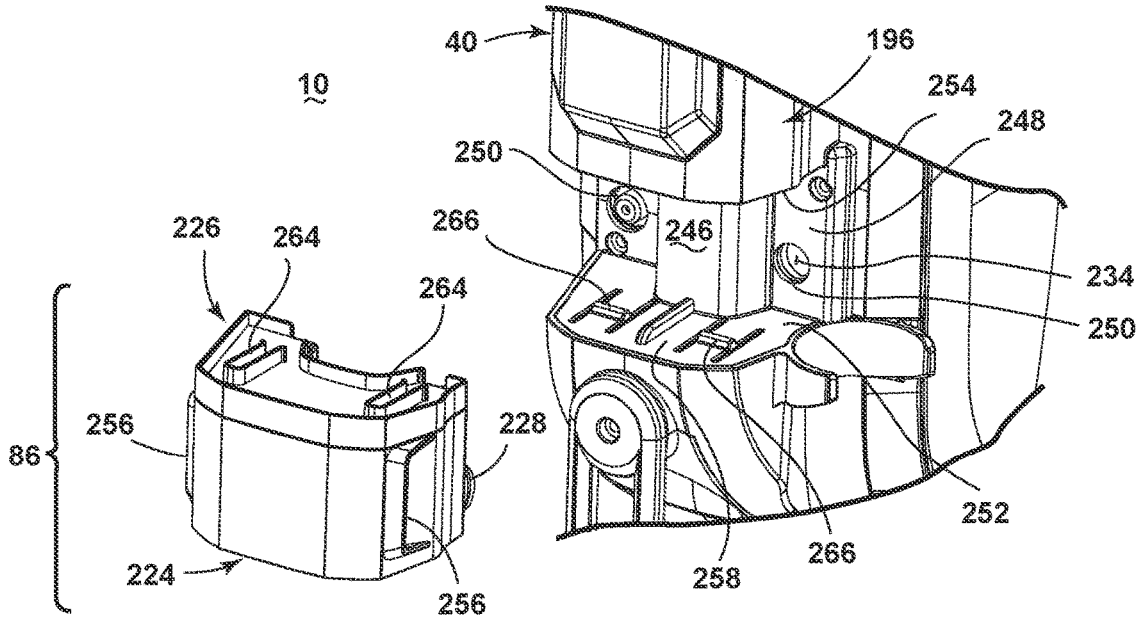
FIG. 13 is a partially exploded view of the steam/vacuum cleaner from FIG. 2, showing the filter assembly removed from the steam/vacuum cleaner from a top perspective.
Figure 14:
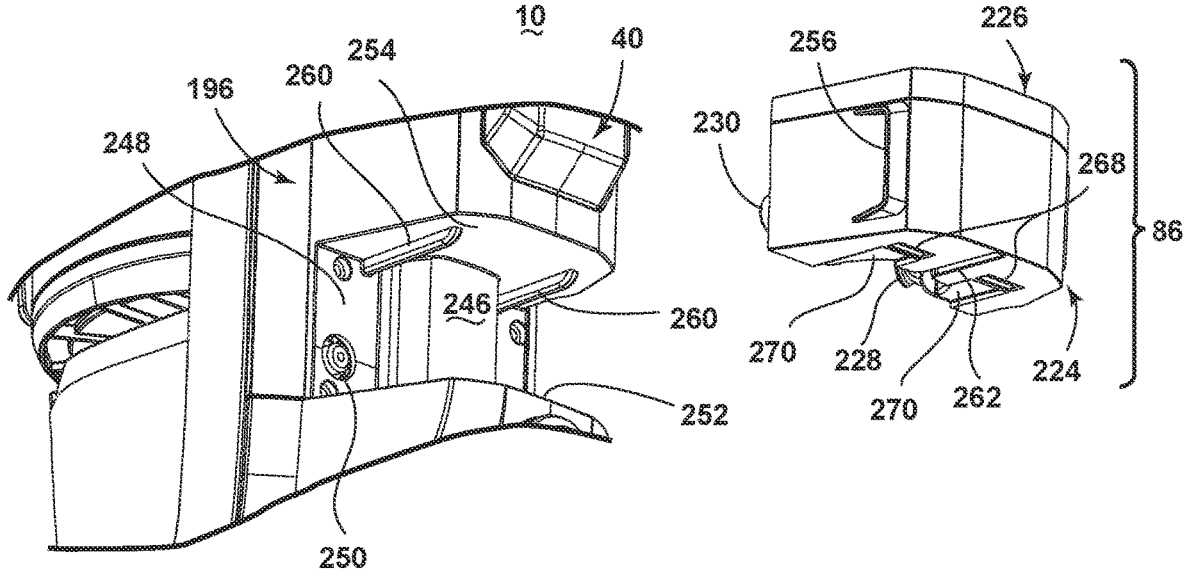
FIG. 14 is a partially exploded view of the steam/vacuum cleaner from FIG. 2, showing the filter assembly removed from the steam/vacuum cleaner from a bottom perspective.

FIG. 13-14 are partially exploded views showing the filter assembly 86 removed from the steam/vacuum cleaner 10 from a top and bottom perspective. The filter assembly 86 can be removable from the steam/vacuum cleaner 10. The steam/vacuum cleaner 10 comprises a filter receiver 246 for receiving the filter assembly 86. The filter receiver 246 can be defined by the rear cover 196 and comprises a rear wall 248 with openings 250 which facilitate fluid connection of the filter assembly 86 with the valve outlet seat 234 and the pump 52 (FIG. 9), a platform 252, and a ceiling 254, at least one of which can have coupling features for releasably retaining the filter assembly 86 within the filter receiver 246. Hand grips 256 can be provided on the filter housing 224 for aiding the user in removing the filter assembly 86 from the steam/vacuum cleaner 10. The valve assembly 232 is not removable from the steam/vacuum cleaner 10 with the filter assembly 86.

The filter receiver 246 includes rails 258, 260 provided on the platform 252 and the ceiling which can be slidingly received by corresponding grooves 262, 264 on the filter assembly 86. In the illustrated example, the platform 252 is provided with one rail 258 which can be received by a corresponding groove 262 on the bottom of the filter housing 224, and the ceiling 254 is provided with two rails 260 which can be received by corresponding grooves 264 on the top of the filter cover 226.

The filter receiver 246 further includes at least one detent 266 which can be received by a corresponding detent receiver 268 on the filter assembly 86 to retain the filter assembly 86 on the steam/vacuum cleaner 10 when the upper housing 12 is inclined during use. In the illustrated example, the platform 252 is provided with two detents 266 positioned outside the guide rail 258 which are received by corresponding detent receivers 268 on the bottom of the filter housing 224. Detent guides 270 leading to the detent receivers 268 can be provided on the bottom of the filter housing 224 and can guide the detents 266 into the detent receivers 268 by aligning the detents 266 with the detent receivers 268 as the filter assembly 86 slides over the rails 258, 260.

Figure 15:
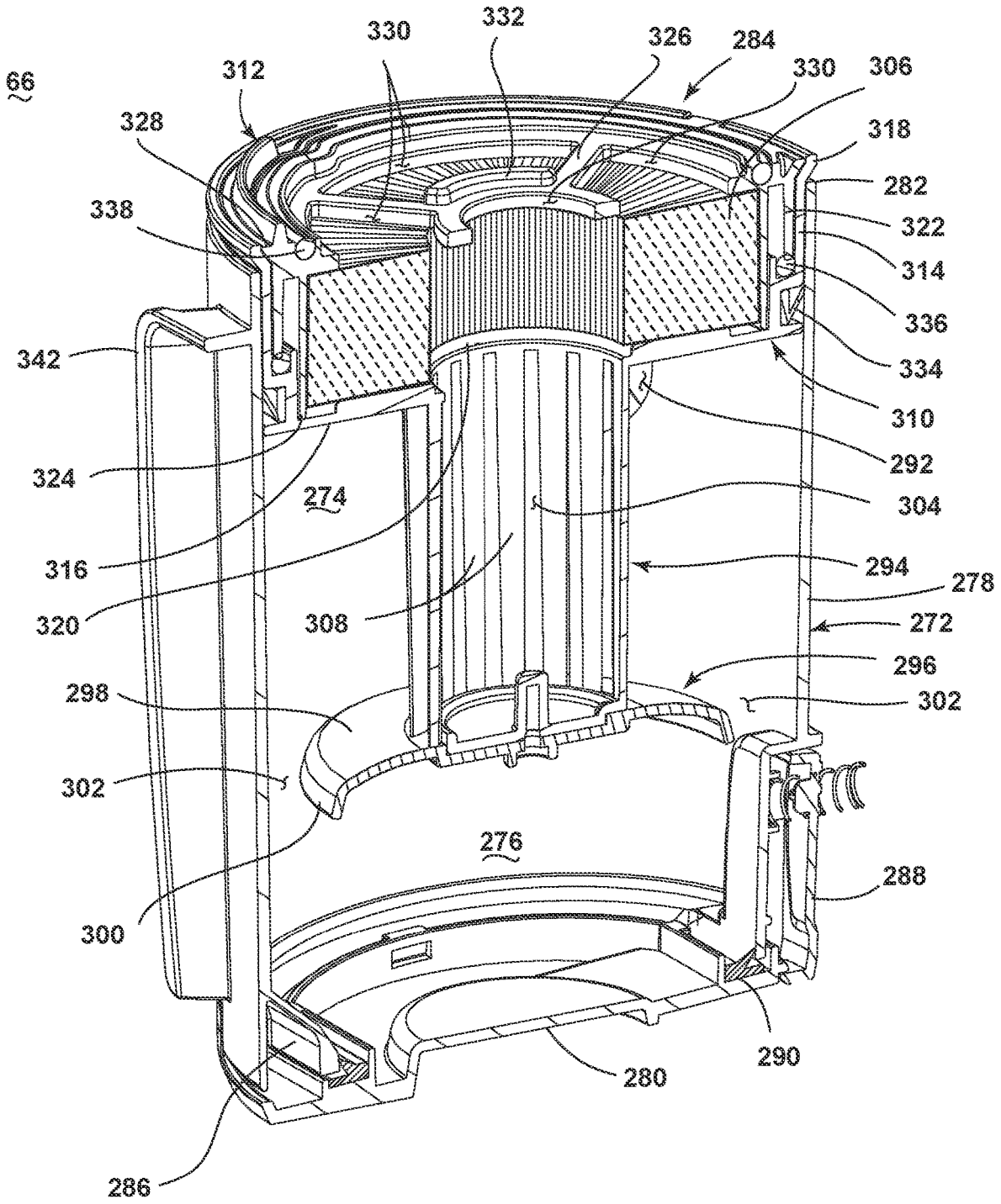
FIG. 15 is a perspective, cross-sectional view of a collection system for the steam/vacuum cleaner from FIG. 2.

FIG. 15 is a perspective, cross-sectional view of the collection system 66. The collection system 66 comprises a housing 272 at least partially defining a single-stage cyclone chamber 274 for separating contaminants from a dirt-containing working airstream and an integrally-formed dirt collection chamber 276 which receives contaminants separated by the cyclone chamber 274. The housing 272 is common to the cyclone chamber 274 and the collection chamber 276, and includes a side wall 278, a bottom wall 280, and an open top defined by an upper edge 282 of the side wall 278. The side wall 278 is illustrated herein as being generally cylindrical in shape. The bottom wall 280 comprises a dirt door that can be selectively opened, such as to empty the contents of the collection chamber 276. A cover assembly 284 is removably mounted to the housing 272 to partially close the open top.

The dirt door 280 is pivotally mounted to the side wall by a hinge 286. A door latch 288 is provided on the side wall 278, opposite the hinge 286, and can be actuated by a user to selectively release the dirt door 280 from engagement with the bottom edge of the side wall 278. The door latch 288 is illustrated herein as comprising a latch 288 that is pivotally mounted to the side wall 278 and spring-biased toward the closed position shown in FIG. 15. By pressing the upper end of the door latch toward the side wall 278, the lower end of the door latch 288 pivots away from the side wall 278 and releases the dirt door 280, under the force of gravity, allowing accumulated dirt to be emptied from the collection chamber 276 through the open bottom of the housing 272. A gasket 290 can be provided between the dirt door 280 and the bottom edge of the side wall 278 to seal the interface therebetween when the dirt door 280 is closed.

An air inlet to the cyclone chamber 274 can be at least partially defined by an inlet conduit 292. An air outlet from the cyclone chamber 274 can be at least partially defined by an exhaust grill 294 which guides working air out of the housing 272. The inlet conduit 292 is in fluid communication with the suction nozzle 62 (FIG. 2) and the exhaust grill 294 is in fluid communication with the suction source 64 (FIG. 9). The exhaust grill 294 is positioned in the center of the cyclone chamber 274 and can depend from a bottom wall of the cover assembly 284. A separator plate 296 can be provided below the exhaust grill 294 to separate the cyclone chamber 274 from the collection chamber 276, and can include a disk-like surface 298 extending radially outwardly from the grill 294 and a downwardly depending peripheral lip 300. A debris outlet 302 from the cyclone chamber 274 can be defined between the separator plate 296 and the side wall 278 of the housing 272. The exhaust grill 294 separates the cyclone chamber 274 from a passageway 304 leading to a pre-motor filter 306 within the cover assembly 284, and includes a generally cylindrical body having a plurality of longitudinally-extending vanes or louvers 308.

The cover assembly 284 includes a lower cover 310 and an upper cover 312 which can be mounted to the lower cover 310 and which together define a filter chamber which can receive the filter 306. The lower cover 310 includes a side wall 314, a bottom wall 316, and an open top defined by an upper edge 318 of the side wall 314. The upper edge 318 of the side wall 314 can be formed as a lip, which rests on the upper edge 282 of the housing 272 when the cover assembly 284 is received in the open top of the housing 272. The bottom wall 316 includes a central opening 320 allowing air to pass out of the exhaust grill 294. The upper cover 312 includes a side wall 322, an open bottom defined by a lower edge 324 of the side wall 322, and a top wall 326. The top wall 326 can have a lattice-like frame with a peripheral lip 328, which rests on the upper edge 318 of the lower cover 310 when the upper cover 312 is received in the lower cover 310. The frame includes multiple openings 330 allowing air to pass out of the filter 306. A handle grip 332 attached to the top wall 326 can be gripped by a user to facilitate lifting the upper cover 312 off the lower cover 310 to access the filter 306 for cleaning or replacement. The filter 306 can comprise a pleated HEPA filter. A first seal 334 is provided between the lower cover 310 and the housing 272, a second seal 336 is provided between the lower cover 310 and upper cover 312, and a third seal 338 is provided on top of the upper cover 312 for providing fluid-tight interfaces therebetween.

With additional reference to FIG. 9, the collection system 66 can have a latch mechanism 340 that selectively secures the collection system 66 to the steam/vacuum cleaner 10 in a position to receive debris and liquid. The latch mechanism 340 also allows the collection system 66 to be selectively removed from the steam/vacuum cleaner 10, as shown in FIG. 9, so that the collection chamber 276 can be emptied and the filter 306 can be cleaned or replaced. A handle grip 342 attached to the housing 272 can be gripped by a user to facilitate removing collection system 66 from the upper housing 12.

The steam/vacuum cleaner 10 shown in FIGS. 2-15 can be used to effectively remove liquid and debris (which may include dirt, dust, stains, and other debris) from the surface to be cleaned in accordance with the following method. The sequence of steps discussed is for illustrative purposes only and is not meant to limit the method in any way as it is understood that the steps may proceed in a different logical order, additional or intervening steps may be included, or described steps may proceed concurrently, or be divided into multiple steps.

In operation, the steam/vacuum cleaner 10 can be utilized in a vacuum only mode, a steam only mode, or a concurrent vacuum and steam mode. For vacuum cleaning, the suction source 64 is energized and draws liquid and debris-containing air from the suction nozzle 62 to the collection system 66 where the liquid and debris are separated from the working air. The working air, which may still contain some smaller or finer debris, then passes through the exhaust grill 294 which can separate out some additional debris. The working air, which may still contain some even smaller or finer debris, passes through the pre-motor filter 306, where additional debris may be captured. The working air then exits the collection system 66 and passes through the suction source 64 before being exhausted from the steam/vacuum cleaner 10. One or more additional filter assemblies may be positioned upstream or downstream of the suction source 64. To dispose of collected liquid and debris, the collection system 66 is detached from the steam/vacuum cleaner 10.

For steam cleaning, the cleaning pad 58 is attached to the foot 14, the supply tank 40 is filled with liquid, and the power cord 38 is plugged into a household electrical outlet. Upon pressing the trigger 48, the pump 52 is activated and liquid flows from the supply tank 40, through the filter assembly 86, to the steam generator 30. In the steam generator 30, liquid is heated to its boiling point to produce steam. The generated steam exits the steam generator 30 and guided downwardly to the foot and through the steam nozzle 122 towards the surface to be cleaned. As steam passes through the cleaning pad 58, a portion of the steam may return to liquid form before reaching the floor surface. A portion of the steam delivered to the floor surface can also return to liquid form. As the damp cleaning pad 58 is wiped over the surface to be cleaned, at least some excess liquid and debris on the surface can absorbed by the cleaning pad 58. Liquid and debris can also be removed from the surface to be cleaned by operation of the vacuum collection system 60.

Figure 16:
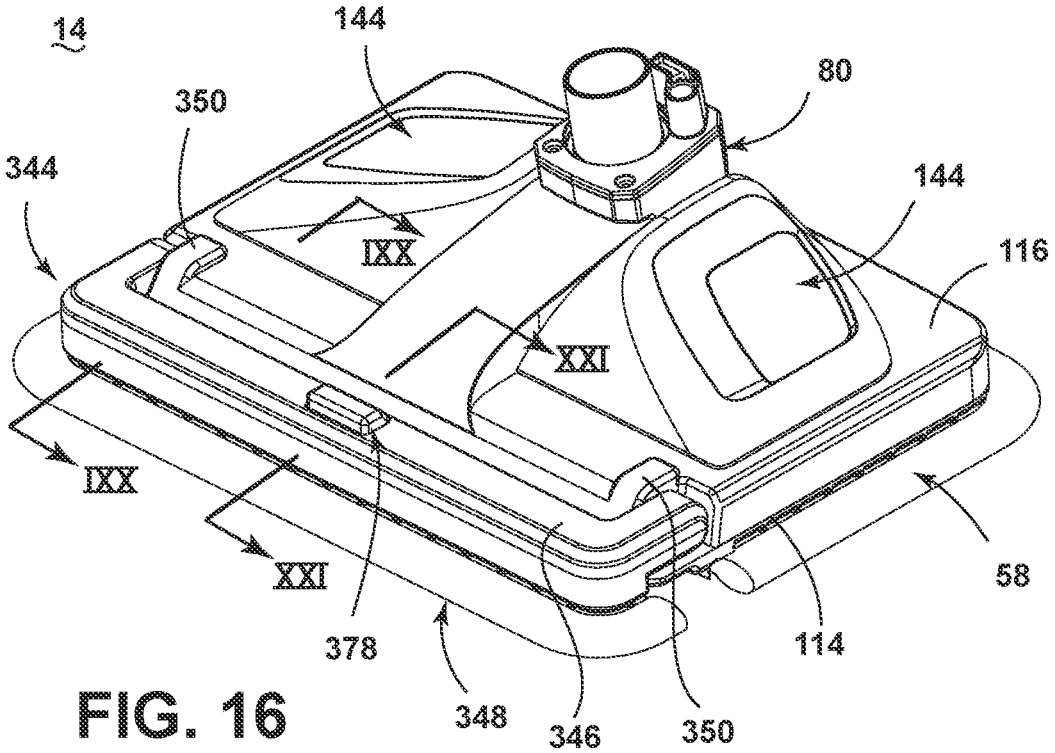
FIG. 16 is a perspective view of a foot, with an auxiliary steam distributor in a use position.

FIG. 16 is a perspective view of a foot 14 according to a second example, in which like elements are identified with the same reference numerals. The foot 14 can be used in place of the foot 14 on the steam/vacuum cleaner 10 shown in FIGS. 1-15, and can be substantially similar to the foot 14 shown the example of FIG. 2, save for the provision of an auxiliary steam distributor 344 pivotally mounted on a front edge of the foot 14. The steam distributor 344 comprises a housing 346 which can mount an auxiliary cleaning pad 348 exterior to the foot 14 and forwardly of the suction nozzle 62, and a mounting assembly comprising a pair of spaced brackets 350 affixed or otherwise formed on the housing 346 for attaching the housing 346 to the foot 14. The housing 346 can be elongated, and can extend substantially the entire width of the suction nozzle 62.

The auxiliary cleaning pad 348 can comprise a separate pad from the cleaning pad 58 mounted on the foot 14 and can be made from the same or a different material than the main cleaning pad 58. Optionally, the cleaning pad 348 can be provided with features that enhance the scrubbing action on the surface to be cleaned to help loosen dirt on the surface. The cleaning pad 348 can be disposable or reusable, and can further be provided with a cleaning agent or composition that is delivered to the surface to be cleaned along with the steam. For example, the cleaning pad 348 can comprise disposable sheets that are pre-moistened with a cleaning agent. The cleaning agent can be configured to interact with the steam, such as having at least one component that is activated or deactivated by the temperature and/or moisture of the steam. In one example, the temperature and/or moisture of the steam can act to release the cleaning agent from the cleaning pad 348.

Figure 17:
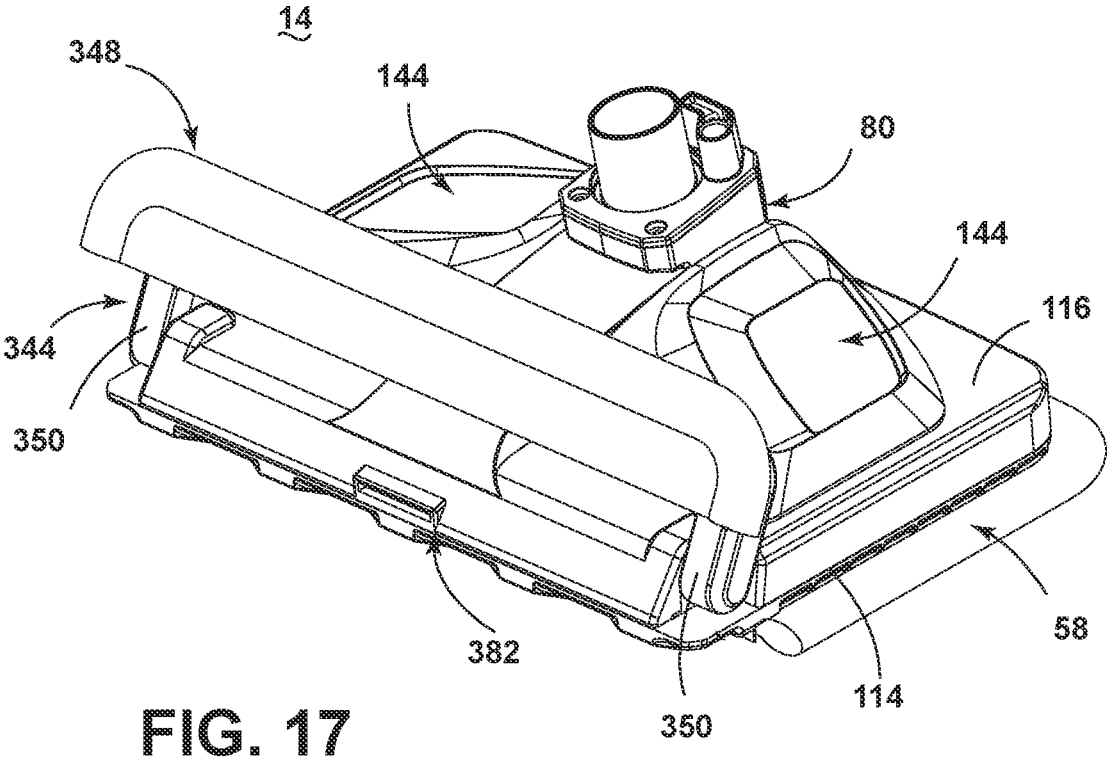
FIG. 17 is a perspective view of the foot from FIG. 16, with the auxiliary steam distributor in a non-use position.

The steam distributor 344 is movable between a use position, shown in FIG. 16, in which the secondary cleaning pad 348 is in contact with the surface to be cleaned, and a non-use position, shown in FIG. 17, in which the secondary cleaning pad 348 is spaced from the surface to be cleaned. In the use position, the secondary cleaning pad 348 is positioned forwardly of the suction nozzle 62 and is configured to wipe the surface to be cleaned as the foot 14 is moved over it. In the non-use position, the secondary cleaning pad 348 is out of contact with the surface to be cleaned and access along the front edge of the suction nozzle 62 is improved.

Figure 18:
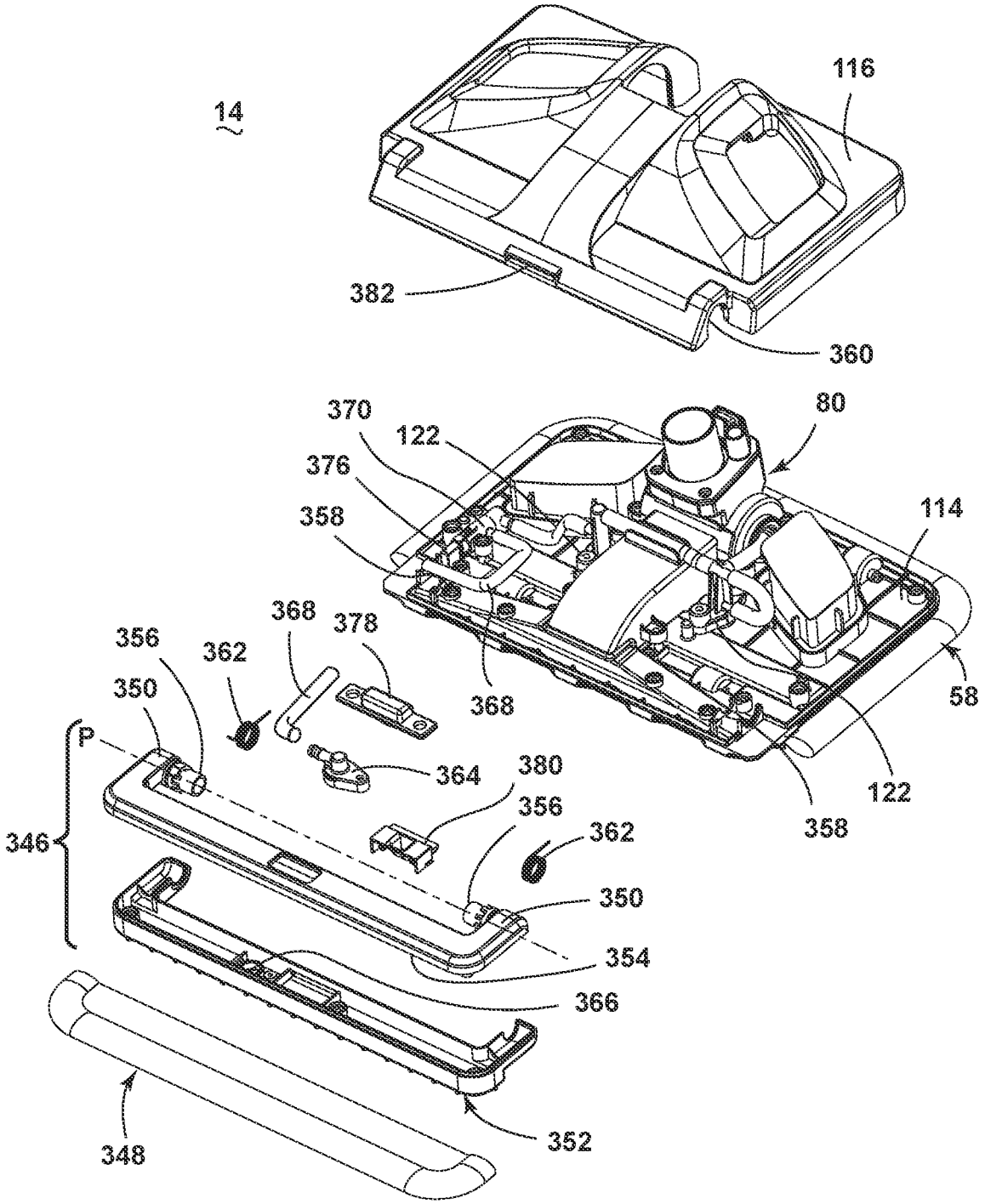
FIG. 18 is a partially exploded view of the foot from FIG. 16.

FIG. 18 is a partially exploded view of the foot 14 from FIG. 16. The housing 346 includes a base frame 352 and a cover frame 354 mounted to the top of the base frame 352. The cleaning pad 348 can be mounted on the bottom of the base frame 352. The cover frame 354 includes pivot arms 356 extending inwardly from the brackets 350 and which define a pivot axis P about which the housing 346 can be rotated relative to the foot 14. The foot 14 can have corresponding cradles for receiving the pivot arms 356 formed by mating cradle halves 358, 360 on the base frame 114 and the base cover 116 that sandwich the pivot arms 356 therebetween. To move to the non-use position, the housing 346 is rotated about the pivot axis P until the brackets 350 rest against an upper surface of the base cover 116. Biasing elements 362 can be provided to bias the housing 346 toward the non-use position shown in FIG. 17. The biasing elements 362 can comprise springs in the form of torsion springs wrapped around the pivot arms 356 and bearing against the housing 346.

The foot 14 includes multiple steam nozzles for dispensing steam to the cleaning pads 58, 348. The main foot 14 is provided with two steam nozzles 122, substantially as described above, which are coupled with the steam generator 30 (FIGS. 1 and 9) through the coupling joint 80 and distribute steam to the main cleaning pad 58 through steam orifices in the base frame 114. The auxiliary steam distributor 344 includes an auxiliary steam nozzle 364 coupled with one of the main steam nozzles 112. The auxiliary steam distributor 344 further includes at least one steam outlet in fluid communication with the auxiliary steam nozzle 364. In the illustrated example, the at least one steam outlet includes a steam orifice 366 formed in the base frame 352 of the housing 346. At least one of the pivot arms 356 can be hollow for the passage of a fluid conduit 368 from the main steam nozzle 122 to the auxiliary steam nozzle 364. At least a portion of the fluid conduit 368 can be flexible to accommodate for the movement of the housing 346.

Figure 19:
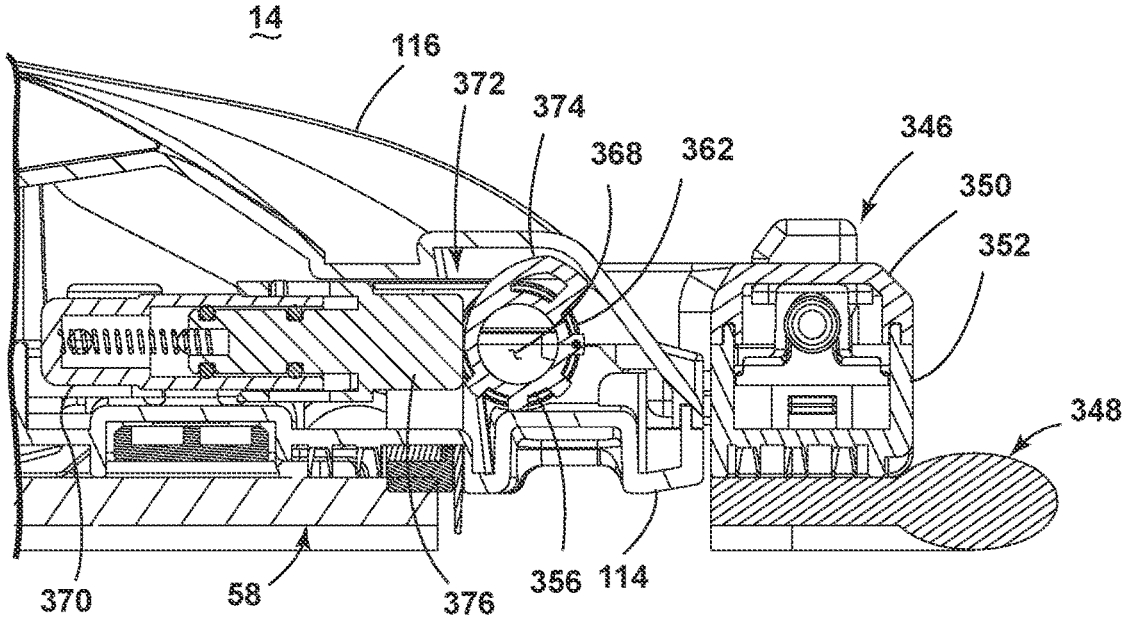
FIG. 19 is a cross-sectional view through a valve assembly for the steam distributor of the foot from FIG. 16, with the valve assembly in an open position.
Figure 20:
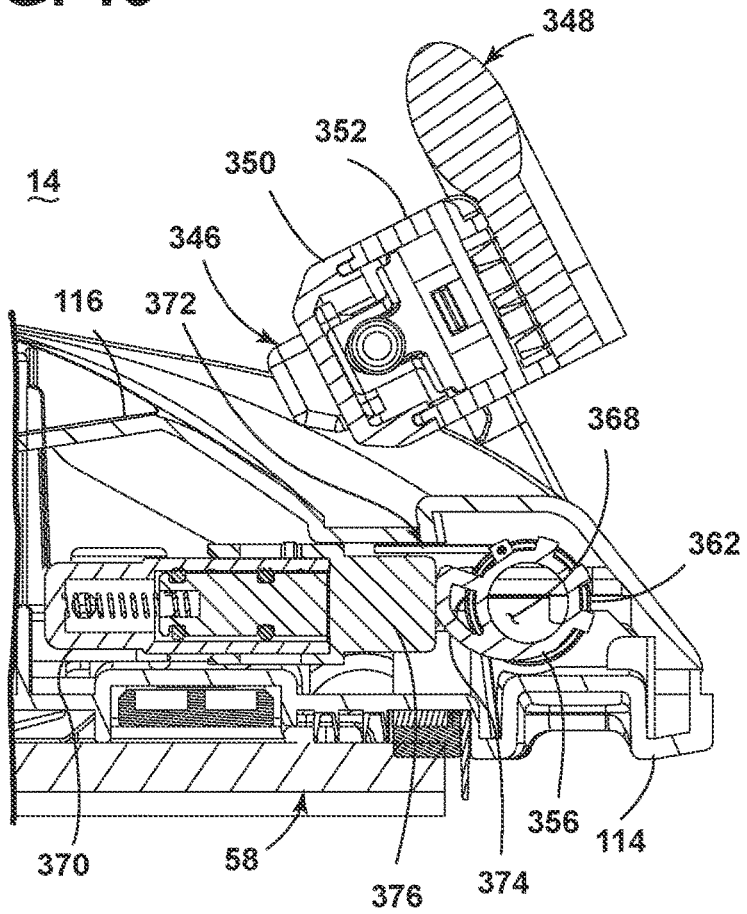
FIG. 20 is a cross-sectional view similar to FIG. 19, with the valve assembly in a closed position.

A valve 370 for controlling the delivery of steam to the auxiliary steam nozzle 364 can be provided in the fluid conduit 368, and can comprise a one-way valve that is open only when the steam distributor 344 is in the use position (FIGS. 16 and 19). A valve actuator 372 links the open or closed configuration of the valve 370 with the movement of the housing 346 between the use and non-use positions, such that the valve 370 is open when the steam distributor 344 is in the use position (FIGS. 16 and 19) and closed when the steam distributor 344 is in the non-use position (FIGS. 17 and 20). One example of the valve actuator illustrated in the figures comprises a cam 374 operably coupled with one of the pivot arms 356 and a cam follower 376 coupled with the valve 370. The cam 374 can be operably fixed to the pivot arm 356 for movement therewith, such that as the steam distributor 344 pivots between the use and non-use positions, the cam 374 will likewise rotate.

When the steam distributor 344 is rotated between the use and non-use positions, the profile of the cam 374 is used to transform the rotational movement to linear movement of the cam follower 376 to open or close the valve 370. The cam 374 shown herein is configured with a profile that extends the cam follower 376 to open the valve 370 when the steam distributor 344 is in the use position, as shown in FIG. 19, and depresses the cam follower 376 to close the valve 370 when the steam distributor 344 is in the non-use position, as shown in FIG. 20.

Figure 21:
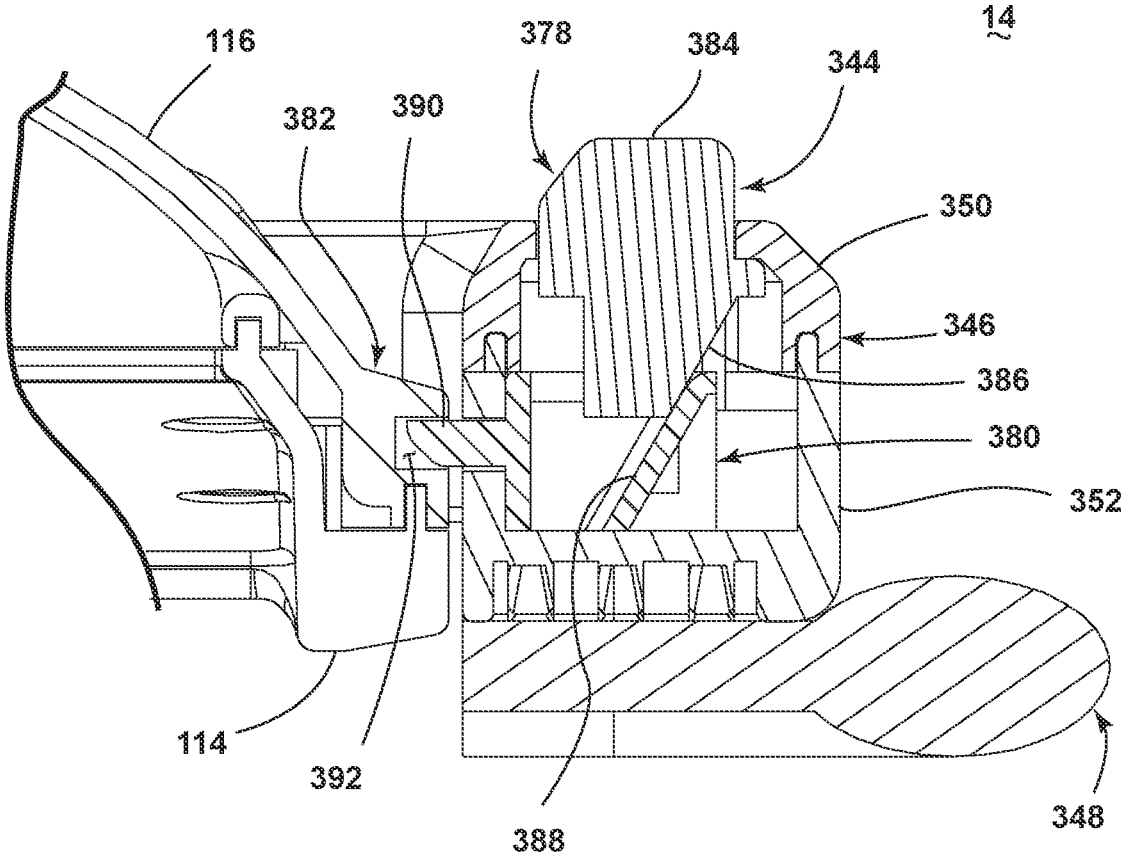
FIG. 21 is a cross-sectional view through a latch assembly for the steam distributor of the foot from FIG. 16.

FIG. 21 is a cross-sectional view through a latch assembly for the steam distributor 344. The latch assembly can be provided for selectively retaining the steam distributor 344 in the use position and comprises a latch button 378 provided on the top of the steam distributor housing 346, a latch 380 operably coupled with the latch button 378 and slidably mounted within the housing 346 to selectively engage a latch receiver 382 on the front of the foot 14.

The latch button 378 is vertically movable within the housing 346 and has an upper user-engageable surface 384 which extends exteriorly from the cover frame 354 and a lower angled body 386 extending below the cover frame 354. The latch 380 is horizontally movable within the housing 346 and has an angled pocket 388 which receives the lower angled body 386 of the latch button 378 and a catch 390 extending rearwardly through a slot in the housing 346. The latch receiver 382 comprises a recess 392 formed in the front of the base cover 116 that is configured to receive the catch 390. At least one biasing element (not shown) biases the catch 390 towards the latch receiver 382.

The latch assembly can be released by pressing vertically downwardly on the user-engagable surface 384, which forces the angled body 386 of the latch button 378 against the angled pocket 388 of the latch 380 and urges the latch 380 to slide outwardly until the catch 390 clears the recess 392 on the base cover 116, whereby the torsion springs 362 (FIG. 18) are free to move the steam distributor 344 upwardly to a non-use position, shown in FIGS. 17 and 20.

In operation, to use the auxiliary steam distributor 344, the foot 14 is moved forward and rearward in a reciprocating fashion over the surface to be cleaned with the steam distributor 344 in the use position. In the use position, steam is delivered to both the main steam nozzles 122 and the auxiliary steam nozzle 364 in the auxiliary steam distributor 344. Both cleaning pads 58, 348 wipe against the surface to be cleaned, thereby absorbing at least some excess liquid and debris on the surface. The auxiliary steam distributor 344 can be moved to the non-use position for vacuum cleaning using the suction nozzle 62.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A surface cleaning apparatus, comprising:

a housing comprising a cleaning foot and an upper housing operably coupled to the cleaning foot, the cleaning foot having a bottom;

a suction nozzle provided on the cleaning foot;

a suction source fluidly connected to the suction nozzle by a working air conduit;

a steam port comprising an aperture provided in the cleaning foot;

a steam supply system comprising a steam nozzle having at least a portion that projects through the steam port, the steam nozzle comprising at least one steam orifice; and a flexible seal provided around the steam nozzle and located between the steam port and the steam orifice.

2. The surface cleaning apparatus of claim 1, wherein the cleaning foot further comprises a base frame and the steam port is formed in the base frame.

3. The surface cleaning apparatus of claim 2, wherein the cleaning foot further comprises a pad mounting plate provided on a bottom of the base frame.

4. The surface cleaning apparatus of claim 3, wherein the flexible seal is spool-shaped and comprises a barrel having an upper flange and a lower flange.

5. The surface cleaning apparatus of claim 4, wherein the barrel extends through the steam port, with the upper flange holding the flexible seal on the base frame and the lower flange contacting an upper surface of the pad mounting plate and surrounding the at least one steam orifice.

6. The surface cleaning apparatus of claim 3, wherein the pad mounting plate is moveable relative to the base frame.

7. The surface cleaning apparatus of claim 3, wherein the pad mounting plate is adapted to mount a cleaning pad to be moved across the surface to be cleaned.

8. The surface cleaning apparatus of claim 3, wherein the flexible seal extends through the steam port.

9. The surface cleaning apparatus of claim 8, wherein a first end of the flexible seal directly contacts a portion of the steam nozzle and a second end of the flexible seal contacts a portion of the pad mounting plate.

10. The surface cleaning apparatus of claim 9, wherein the flexible seal is spool-shaped and includes a first flange including the first end, a second flange including the second end, and a barrel connecting the first flange and the second flange.

11. The surface cleaning apparatus of claim 1, wherein the flexible seal extends through the steam port.

12. The surface cleaning apparatus of claim 1, wherein the steam supply system further comprises a supply tank provided on the housing and a steam generator in fluid communication with the supply tank and adapted to heat a liquid to produce steam, with the steam generator being fluidly coupled to the steam nozzle.

13. The surface cleaning apparatus of claim 12, wherein the supply tank is provided with the upper housing.

14. The surface cleaning apparatus of claim 1, wherein the flexible seal is spool-shaped.

15. The surface cleaning apparatus of claim 1, wherein the flexible seal includes a first flange, a second flange, and a barrel extending between the first flange and the second flange.

16. The surface cleaning apparatus of claim 15, wherein the cleaning foot further comprises a pad mounting plate.

17. The surface cleaning apparatus of claim 16, wherein the first flange contacts a portion of the cleaning foot and the second flange contacts a portion of the pad mounting plate.

18. The surface cleaning apparatus of claim 16, wherein the pad mounting plate is removably mounted to the cleaning foot.

19. The surface cleaning apparatus of claim 1, further comprising at least one of a cyclone separator or a filter bag fluidly coupled to the working air conduit.

20. The surface cleaning apparatus of claim 1, wherein the steam port surrounds the flexible seal.

* * * * *